United States Patent [19]

Fleckenstein et al.

[11] 4,152,153

[45] * May 1, 1979

[54] SULFONAMIDO DYE RELEASING COMPOUNDS IN PHOTOGRAPHIC ELEMENTS

[75] Inventors: Lee J. Fleckenstein; John Figueras, both of Rochester, N.Y.

[73] Assignee: Eastman Kodak Company, Rochester, N.Y.

[ * ] Notice: The portion of the term of this patent subsequent to Oct. 11, 1994, has been disclaimed.

[21] Appl. No.: 790,641

[22] Filed: Apr. 25, 1977

Related U.S. Application Data

[63] Continuation-in-part of Ser. No. 503,144, Sep. 4, 1974, abandoned, which is a continuation-in-part of Ser. No. 351,673, Apr. 16, 1973, Pat. No. 4,076,529, which is a continuation-in-part of Ser. No. 282,796, Aug. 22, 1972, abandoned, which is a continuation-in-part of Ser. No. 176,751, Aug. 31, 1971, abandoned.

[51] Int. Cl.[2] ..... G03C 7/00; G03C 1/40; G03C 7/16; G03C 1/76

[52] U.S. Cl. ..... 96/3; 96/16; 96/21; 96/22; 96/29 D; 96/51; 96/54; 96/56.6; 96/73; 96/74; 96/77; 96/99; 96/100 R

[58] Field of Search ..... 96/3, 29 D, 77, 56.6, 96/55, 51, 100 R, 99, 21, 22, 54, 16

[56] References Cited

U.S. PATENT DOCUMENTS

| | | | |
|---|---|---|---|
| 2,306,410 | 12/1942 | Schinzel | 96/100 |
| 3,443,940 | 5/1969 | Bloom et al. | 96/3 |
| 3,698,897 | 10/1972 | Gompf et al. | 96/3 |
| 3,734,726 | 5/1973 | Figueras et al. | 96/3 |

FOREIGN PATENT DOCUMENTS

| | | |
|---|---|---|
| 2406664 | 8/1975 | Fed. Rep. of Germany. |
| 512559 | 9/1939 | United Kingdom. |

OTHER PUBLICATIONS

"N-Aryl Sulfonylquinonimines", Burmistrov et al., *Zhurnal Obshchei Khimii,* 22, 999 1952.

"The Indophenol . . . Amines", Titov et al., *Zhurnal Obshchei Khimii,* 30, 623 1960.

*Primary Examiner*—Richard C. Schilling

*Attorney, Agent, or Firm*—Harold E. Cole

[57] ABSTRACT

A dye-releasing mechanism is described which employs a nondiffusible dye-releasing compound having a dye or dye-precursor moiety attached thereto through a sulfonamido cleavage linkage so that a diffusible sulfonamide dye or dye-precursor will be released upon oxidation and subsequent alkaline hydrolysis of the compound.

9 Claims, No Drawings

SULFONAMIDO DYE RELEASING COMPOUNDS IN PHOTOGRAPHIC ELEMENTS

This application is a continuation-in-part of our copending application Ser. No. 503,144, filed Sept. 4, 1974 now abandoned, which in turn is a continuation-in-part of our copending application Ser. No. 351,673, filed Apr. 16, 1973 and now U.S. Pat. No. 4,076,529, which in turn is a continuation-in-part of application Ser. No. 282,796, filed Aug. 22, 1972, now abandoned, which in turn is a continuation-in-part of application Ser. No. 176,751, filed Aug. 31, 1971, now abandoned.

This invention relates to photography and more particularly to color photography employing nondiffusible dye-releasing compounds which release a sulfonamide dye or dye-precursor upon oxidation and subsequent alkaline hydrolysis.

Color diffusion transfer processes of the prior art such as U.S. Pat. No. 2,983,606 generally involve the use of a photographic element comprising a support coated with at least one silver halide emulsion layer having therein or contiguous thereto a dye developer. A liquid processing composition is applied to the photographic element and permeates the emulsion layer to dissolve the dye developer. As the exposed silver halide emulsion is developed, the oxidation product of the dye developer is immobilized or precipitated in situ with the developed silver, thereby providing an imagewise distribution of unoxidized dye developer dissolved in the liquid processing composition. This immobilization is apparently due, at least in part, to a change in the solubility characteristics of the dye developer upon oxidation, and particularly as regards its solubility in alkaline solutions. At least part of this imagewise distribution of unoxidized dye-developer is transferred to a superposed image-receiving layer to provide the transfer image.

In these processes of the prior art, the developer moiety of the dye developer is capable of developing any exposed silver halide emulsion layer that it comes into contact with, since it is a "reactive" species. For example, a cyan dye developer which is desired to develop only the red-sensitive silver halide emulsion layer will develop the blue-sensitive and/or green-sensitive silver halide emulsion layers if development by the yellow and magenta dye developers, respectively, has not been completed by the time the cyan dye developer reaches these layers. Such unwanted wrong-layer development results in undesirable interimage effects. Accordingly, it is highly desirable to provide an improved transfer system in which the dye is not attached to a "reactive" moiety, such as a developer moiety, so that such dye can diffuse throughout the system without becoming immobilized in the "wrong" areas. This would result in undesirable interimage effects being considerably reduced or eliminated to provide a transfer image with high color quality.

In U.S. Pat. Nos. 3,443,939; 3,443,940; 3,443,941, and 3,442,943, "splittable" ring-closing compounds such as dye developers are described wherein a diffusible dye moiety is split off the compound and transferred to provide the desired image while the remainder of the compound undergoes an internal cyclization or ring closing reaction, usually as a result of reaction with an oxidized aromatic primary amino color developing agent. In U.S. Pat. Nos. 3,227,550; 3,227,551 and 3,227,552, nondiffusible couplers are described in certain embodiments which release preformed dyes as a result of a coupling reaction with oxidized color developing agent. Canadian Pat. No. 602,607 discloses p-phenylenediamine compounds which contain a dye moiety. These compounds can be oxidized to the quinonediimine and with subsequent treatment with strong alkali, deamination takes place releasing a diffusible dye for transfer to a reception layer. However, compounds are desired which provide improved dye-release mechanisms in photographic systems and which do not require the use of a color developing agent.

The immobile compounds of the prior art are also limited in the characteristics of the cleavage group which remains with the diffusible moiety upon cleavage from the ballasted moiety of said compound. Although certain cleavage groups, such as acid groups, which remain on the diffusible moiety impart a high degree of solubility to it, they can also cause other problems such as difficulties in mordanting of the diffusible moiety on the image-receiving layer, as well as side reactions and interactions with other compounds in the element, etc. Other cleavage groups which are not solubilizing groups may cleave from the ballasted portion of the compound with difficulty and may necessitate the presence of additional solubilizing groups on the potentially diffusible moiety which, in turn, requires additional ballast to impart insolubility before cleavage.

It would be desirable to provide a dye-releasing mechanism which employs dye-releasing compounds which have a cleavage linkage between the ballasted moiety and the diffusible moiety which, upon cleavage, provides a solubilizing group on the diffusible moiety, is easy to cleave from the ballasted moiety, and is relatively inert with respect to secondary reactions in the photographic element.

A process according to our invention for producing a photographic image in color comprises:

(a) imagewise-exposing a photographic element comprising a support having thereon at least one photosensitive silver halide emulsion layer having associated therewith a dye-releasing compound, the compound having a ballast group attached thereto to render it nondiffusible during development in an alkaline processing composition, the compound having a dye or dye-precursor moiety attached thereto through a sulfonamido cleavage linkage so that the diffusible moiety $$^{\ominus}HN—SO_2—Col,$$

wherein Col is a dye or dye-precursor, will be released upon oxidation and alkaline hydrolysis of the compound, the ballast group being a separate and distinct moiety from said dye or dye-precursor moiety;

(b) treating the photographic element with an alkaline processing composition in the presence of a silver halide developing agent to effect development of each of the exposed silver halide emulsion layers, thereby oxidizing the developing agent;

(c) the oxidized developing agent thereby cross-oxidizing the dye-releasing compound;

(d) the cross-oxidized dye-releasing compound then cleaving as a result of alkaline hydrolysis at the sulfonamido cleavage linkage to provide an $^{\ominus}HN—SO_2—$ solubilizing group on the Col to form the diffusible moiety $^{\ominus}HN—SO_2—Col$ imagewise as a function of the imagewise exposure of each silver halide emulsion layer; and (e) at least a portion of the imagewise distribution of diffusible $^{\ominus}HN—SO_2—Col$ diffusing out of said element, such as to a dye-image receiving layer to provide a transfer image.

There are many types of dye-releasing compounds which can be employed in our dye-releasing mechanism described above. In one embodiment of our invention, the dye-releasing compound comprises a benzene nucleus having substituents to provide a phenol group, a naphthol group or an aniline group, the benzene nucleus having a dye or dye-precursor moiety attached thereto through a sulfonamido cleavage linkage so that a diffusible sulfonamide dye or dye-precursor will be released upon oxidation and alkaline hydrolysis of the compound.

In another embodiment, dye-releasing compounds useful in this invention are represented by the following formula:

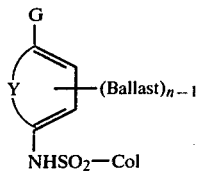

wherein:

(1) Col is a dye or dye precursor moiety;

(2) Ballast is an organic ballasting radical of such molecular size and configuration (e.g., simple organic groups or polymeric groups) as to render the compound nondiffusible in the photographic element during development in an alkaline processing composition;

(3) G is OR or $NHR_1$ wherein R is hydrogen or a hydrolyzable moiety and $R_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when $R_1$ is an alkyl group of greater than 6 carbon atoms, it can serve as a partial or sole Ballast group);

(4) Y represents the atoms necessary to complete a benzene nucleus, a naphthalene nucleus, or a 5 to 7 membered heterocyclic ring, such as pyrazolone, pyrimidine, etc; and (5) n is a positive integer of 1 to 2 and is 2 when G is OR or when $R_1$ is hydrogen or an alkyl group of less than 8 carbon atoms.

In another embodiment of our invention, the dye-releasing compounds are represented by the formula above where —NH—$SO_2$—Col is located ortho to G, as illustrated by U.S. Pat. No. 4,053,312 of Fleckenstein, issued Oct. 4, 1974, the disclosure of which is hereby incorporated by reference.

In another embodiment of our invention, the dye-releasing compounds are represented by the formula:

Ballast—Carrier—NHSO$_2$—Col wherein Ballast and Col are defined as above and Carrier is a moiety as defined and illustrated on pages 68 through 74 of the November, 1976 volume of *Research Disclosure,* the disclosure of which is hereby incorporated by reference.

In still other embodiments of our invention, dye-releasing compounds useful in our invention are described in German Offenlegungsschriften Nos. 2,613,005; 2,406,664; and 2,505,248.

It will be seen from the many types and varieties of dye-releasing compounds described above that there is great latitude in selecting a useful carrier or ballasted moiety. A common feature of all of these compounds is that they have a dye or dye-precursor moiety attached thereto through a sulfonamido cleavage linkage so that a diffusible sulfonamide dye or dye-precursor will be released upon oxidation and alkaline hydrolysis.

It will be appreciated that, after processing the photographic element described above, there remains in it after transfer has taken place an imagewise distribution of dye or dye precursor in addition to developed silver. A color image comprising residual nondiffusible compound may be obtained in this element if the residual silver and silver halide are removed by any conventional manner well-known to those skilled in the photographic art, such as a bleach bath followed by a fix bath, a bleach-fix bath, etc. The imagewise distribution of dye or dye precursor may also diffuse out of the element into these baths, if desired, rather than to an image-receiving element. If a negative-working silver halide emulsion is employed in such photosensitive element, then a positive color image, such as a reflection print, a color transparency or motion-picture film, may be produced in this manner. If a direct-positive silver halide emulsion is employed in such photosensitive element, then a negative color image may be produced.

The photographic element in the above-described process can be treated with an alkaline processing composition to effect or initiate development in any manner. A preferred method for applying processing composition is by use of a rupturable container or pod which contains the composition. In general, the processing composition employed in our process contains the developing agent for development, although the composition could also just be an alkaline solution where the developer is incorporated in the photographic element, in which case the alkaline solution serves to activate the incorporated developer.

A photographic film unit which can be processed in accordance with our invention is adapted to be processed by passing the unit between a pair of juxtaposed pressure-applying members, such as would be found in a camera designed for in-camera processing, and comprises:

(1) a photograhic element as described above;

(2) a dye image-receiving layer; and (3) means for discharging an alkaline processing composition within the film unit, such as a rupturable container which is adapted to be positioned during processing of the film unit so that a compressive force applied to the container by the pressure-applying members will effect a discharge of the container's contents within the film unit;

the film unit containing a silver halide developing agent.

The dye image-receiving layer in the above-described film unit can be located on a separate support adapted to be superposed on the photographic element after exposure thereof. Such image-receiving elements are generally disclosed, for example, in U.S. Pat. No. 3,362,819. A rupturable container is employed and is positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above-described film unit can also be located integral with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer and dye images are formed as a function of development which diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention can be employed is disclosed in Belgian Pat. No. 757,959. In this embodiment, the support for the photographic element is transparent and is coated with the image-receiving layer, a substantially opaque, light-reflective layer and the photosensitive layer or layers described above. A rupturable container containing an alkaline processing composition and an opacifier is positioned adjacent the top layer and a transparent top sheet. The film unit is placed in a camera, exposed through the transparent top sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images are formed as a result of development which diffuse to the image-receiving layer to provide a positive, right-reading image which is viewed through the transparent support on the opaque reflecting layer background. For further details concerning the format of this particular integral film unit, reference is made to the above-mentioned Belgian Pat. No. 757,959.

Still other useful integral formats in which our sulfonamido release mechanism can be employed are described in U.S. Pat. Nos. 3,415,644; 3,415,645; 3,415,646; 3,647,437; and 3,635,707.

In the formula listed above for compounds which are alkali-cleavable upon oxidation, R is preferably hydrogen, although it could be any hydrolyzable entity well-known to those skilled in the art, e.g., acetyl, mono-, di- or trichloroacetyl radicals, perfluoracyl, pyruvyl, alkoxyacyl, nitrobenzoyl, cyanobenzoyl, sulfonyl, sulfinyl, etc.

The nature of the ballast group in the formula for the compounds described above (Ballast) is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms such as a substituted or unsubstituted alkyl group of 8 to 22 carbon atoms, an amide radical having 8 to 30 carbon atoms, a keto radical having 8–30 carbon atoms, etc.

In addition to Ballast and $NHSO_2$—Col, the aromatic nucleus in the above formula may have groups or atoms attached thereto such as the halogens, alkyl, aryl, alkoxy, aryloxy, nitro, amino, alkylamino, arylamino, amido, cyano, alkylmercapto, keto, carboalkoxy, heterocyclic groups, etc. In addition, such groups may combine together with the carbon atoms to which they are attached on the ring to form another ring which may be saturated or unsaturated including a carbocyclic ring, a heterocyclic ring, etc.

As previously mentioned, Col in the above formula represents a dye or dye precursor moiety. Such moieties are well-known to those skilled in the art and include dyes such as azo, azomethine, azopyrazolone, indoaniline, indophenol, anthraquinone, triarylmethane, alizarin, merocyanine, nitro, quinoline, cyanine, indogoide, phthalocyanine, metal complexed dyes, etc., and dye precursors such as a leuco dye, a group containing a reduced imine linkage which upon oxidation forms an imine dye chromophore as described and claimed in U.S. Pat. No. 3,880,658 of Lestina and Bush, issued Apr. 29, 1975, a "shifted" dye which shifts hypsochromically or bathochromically when subjected to a different environment such as a change in pH, reaction with a material to form a complex, etc. Col could also be a coupler moiety such as a phenol, naphthol, indazolone, open-chain benzoyl acetanilide, pivalylacetanilide, malonamide, malonanilide, cyanoacetyl, coumarone, pyrazolone, compounds described in U.S. Pat. No. 2,756,142, etc. These compounds may contain a solubilizing group if desired. Examples of such dye groups include the following:

YELLOW DYE GROUPS

4-Hydroxy azobenzene

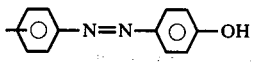

3-methyl-4-hydroxy azobenzene

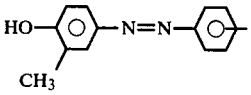

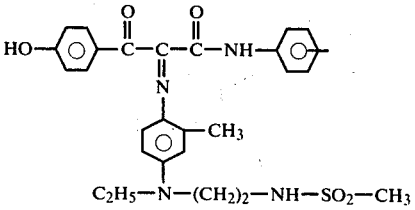

p-sulfhydryl azobenzene

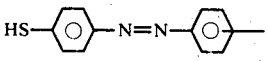

-continued

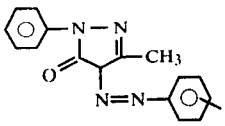

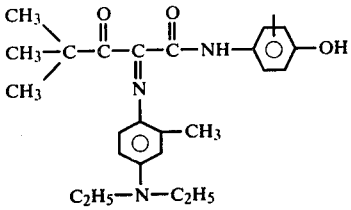

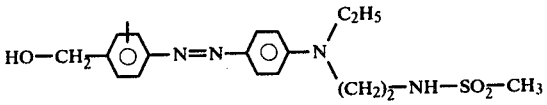

MAGENTA DYE GROUPS

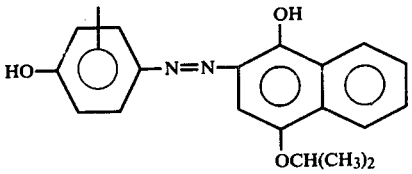

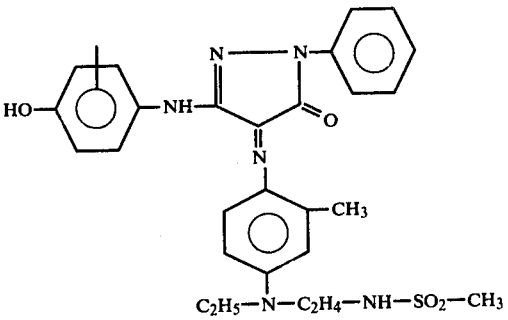

CYAN DYE GROUPS

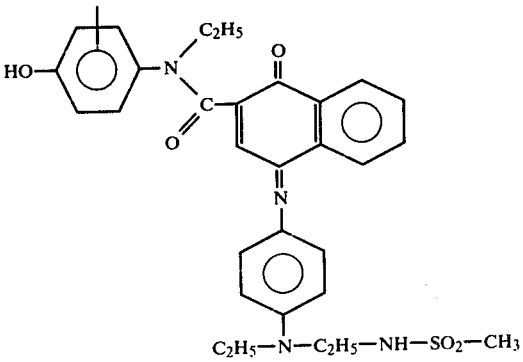

-continued

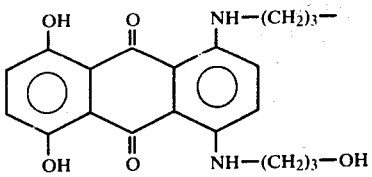

When dye precursor moieties are employed in our invention instead of dyes, they are converted to dyes by means well-known to those skilled in the art, e.g., oxidation, either in the photographic element, in the processing composition or in the dye image-receiving layer to form a visible dye. Such techniques are disclosed, for example, in British Pat. Nos. 1,157,501; 1,157,502; 1,157,503; 1,157,504; 1,157,505; 1,157,506; 1,157,507; 1,157,508; 1,157,509; 1,157,510 and U.S. Pat. Nos. 2,774,668; 2,698,798; 2,698,244; 2,661,293; 2,559,643; etc.

Compounds which may be employed in our invention include the following:

Compound No. I

3-Pentadecyl-4-(p-phenylazobenzenesulfonamido)-phenol

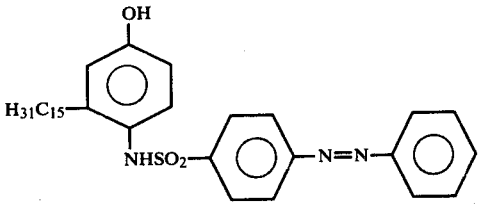

Compound No. II

1-Hydroxy-4-(p-phenylazobenzenesulfonamido)-2-[δ-(2,4-di-tert-amylphenoxy)-n-butyl]-naphthamide

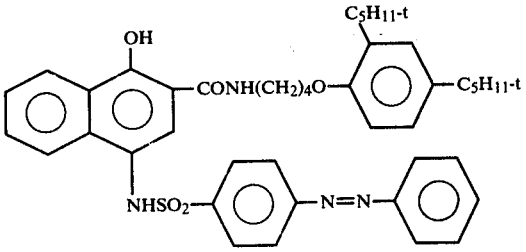

Compound No. III

8-Acetamido-3,6-disulfo-2-{p-[(4-hydroxy-2-pentadecyl)-phenylsulfamoyl]-phenylazo}-1-naphthol monopyridinium salt

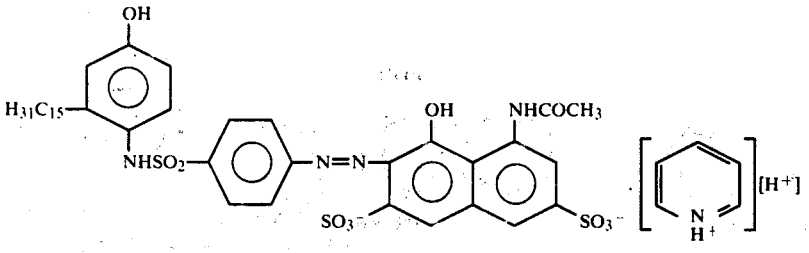

Compound No. IV

2-{p-[(4-Hydroxy-2-pentadecyl)-phenylsulfamoyl]-phenylazo}-4-isopropoxynaphthol

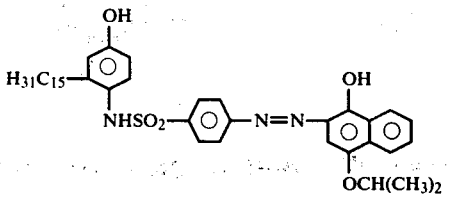

Compound No. V

4-{p-[4'-(N,N-Dimethylamino)-phenylazo]-benzenesulfonamido}-3-pentadecylphenol

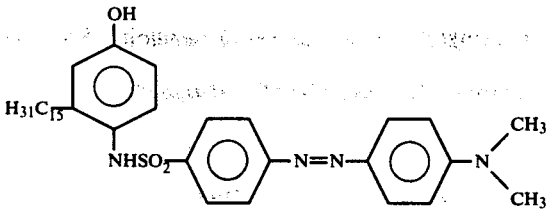

Compound No. VI

1-Hydroxy-4-[4-(1-hydroxy-4-isopropoxy-2-naphthylazo)-benzenesulfonamido]-2-[δ-(2,4-di-tert-amylphenoxy)-n-butyl]-naphthamide

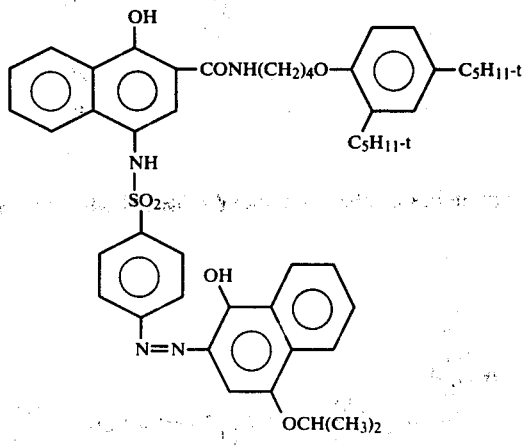

Compound No. VII

1-Hydroxy-4-[3-(1-phenyl-3-methylcarbamyl-4-pyrazolin-5-onylazo)-benzenesulfonamido]-2-[δ-(2,4-di-tert-amylphenoxy)-n-butyl]-naphthamide

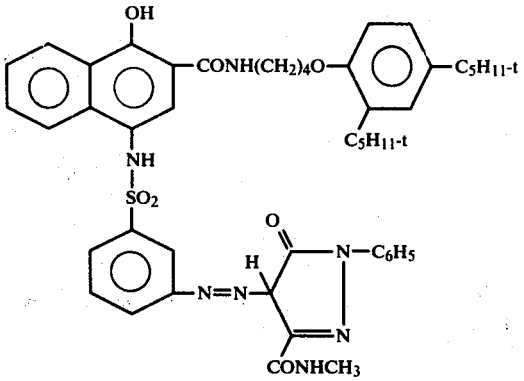

Compound No. VIII

4-[p-(4'-Dimethylaminophenylazo)-benzenesulfonamido]-N-n-dodecylaniline

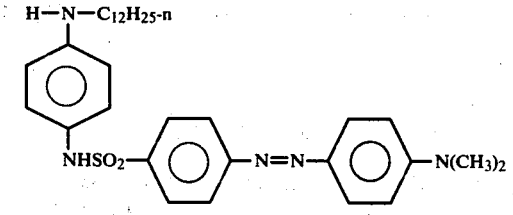

Compound No. IX

3-Pentadecyl-4-(p-phenylazobenzenesulfonamido)-aniline

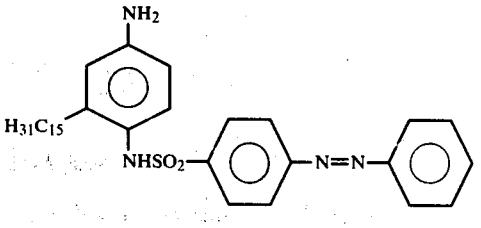

Compound No. X 1-(N-n-Dodecylamino)-4-(p-phenylazobenzenesulfonamido)-naphthalene

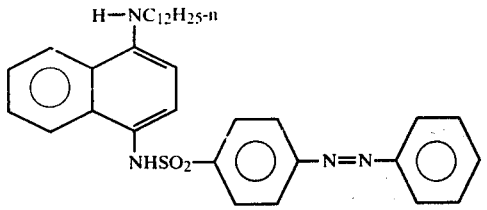

Compound No. XI

2-{p-[(4-amino-2-pentadecyl)-benzenesulfamyl]-phenylazo}-4-isopropoxynaphthol

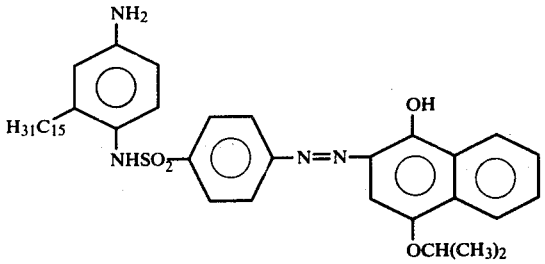

Compound No. XII

4-{p-[4'-(N',N'-dimethylamino)-phenylazo]-benzenesulfonamido}-3-octyl-N-ethylaniline

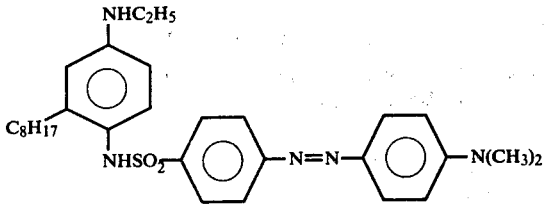

Compound No. XIII

5-{p-[4'-(N,N-Dimethylamino)-phenylazo]-benzenesulfonamido}-8-(N'-n-dodecylamino)-quinoline

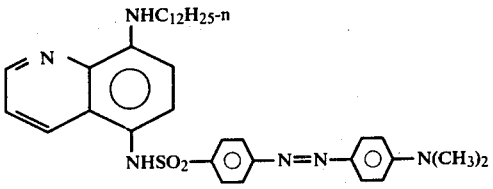

Compound No. XIV—Shifted Magenta Dye-Providing

1-Hydroxy-4-[3-(N-[4-(3,5-dibromo-4-hydroxyphenylimino)-1-phenyl-2-pyrazolin-5-on-3-yl]carbamyl)-benzenesulfonamido]-2-[δ-(2,4-di-tert-amylphenoxy)-n-butyl]naphthamide

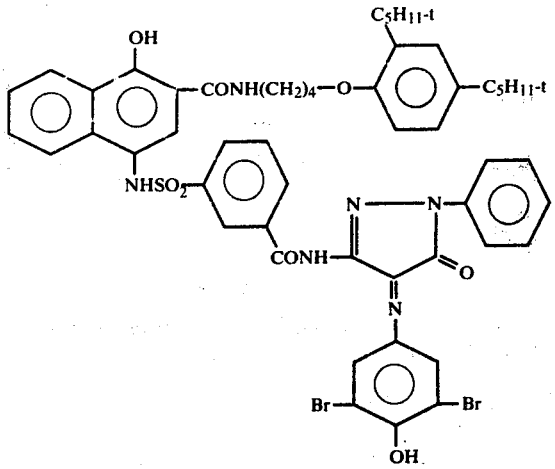

Compound No. XV—Cyan Dye-Providing (Initially Leuco)

1-Hydroxy-4-[3-(4-[3-chloro-5-(3,5-dichloro-4-hydroxyanilino)-2-hydroxy-4-methylanilino]-6-hydroxy-s-triazinyl-2-amino)-benzenesulfonamido]-2-[δ-(2,4-di-tert-amylphenoxy)-n-butyl]naphthamide

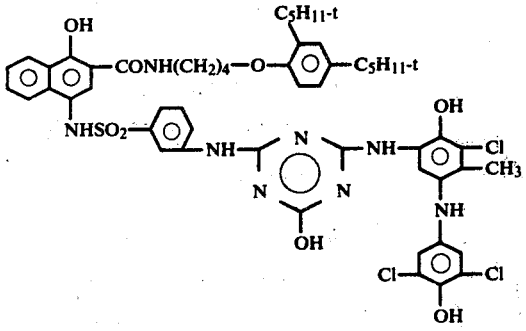

Compound No. XVI—Shifted Yellow Dye-Providing

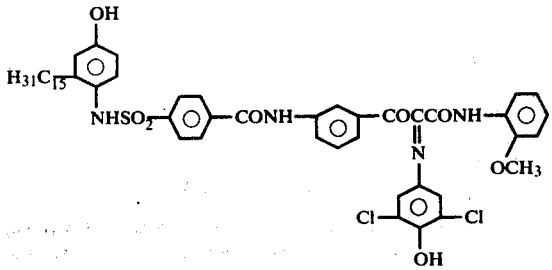

Compound No. XVII—Shifted Yellow Dye-Providing
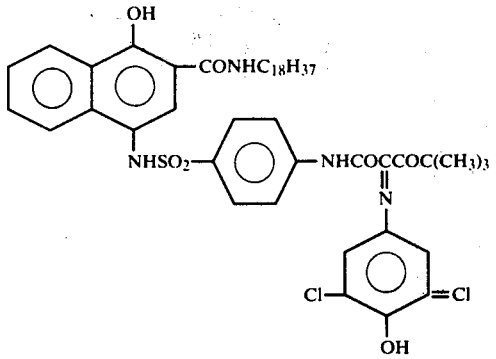
Compound No. XVIII—Shifted Magenta Dye-Providing
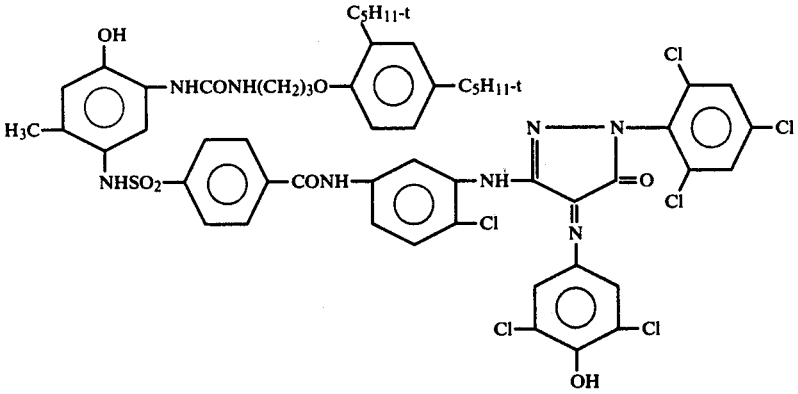
Compound No. XIX—Shifted Magenta Dye-Providing
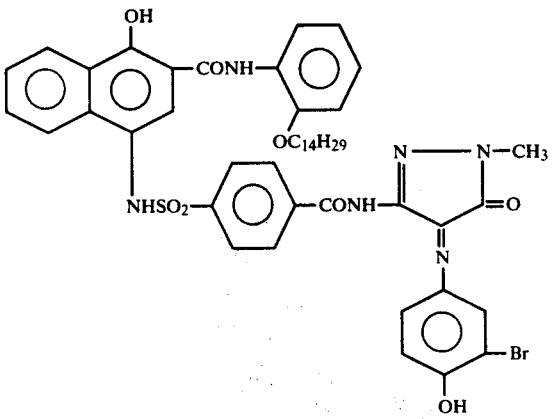
Compound No. XX—Shifted Cyan Dye-Providing
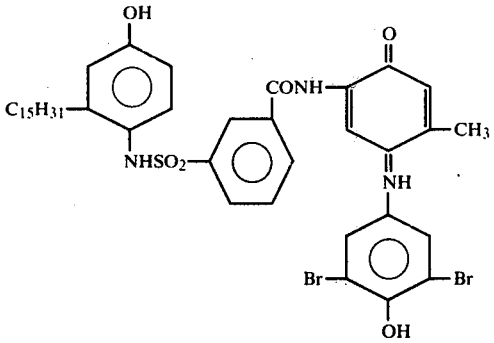
Compound No. XXI—Shifted Cyan Dye-Providing
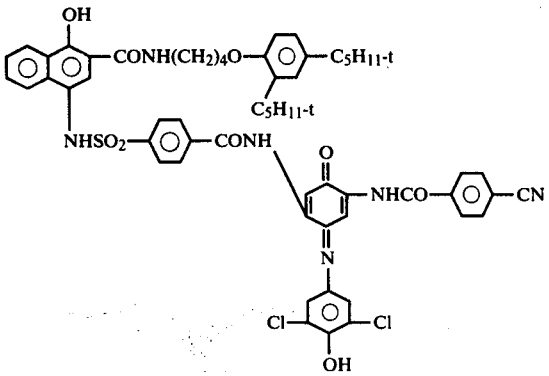
Compound No. XXII—Cyan Dye-Providing

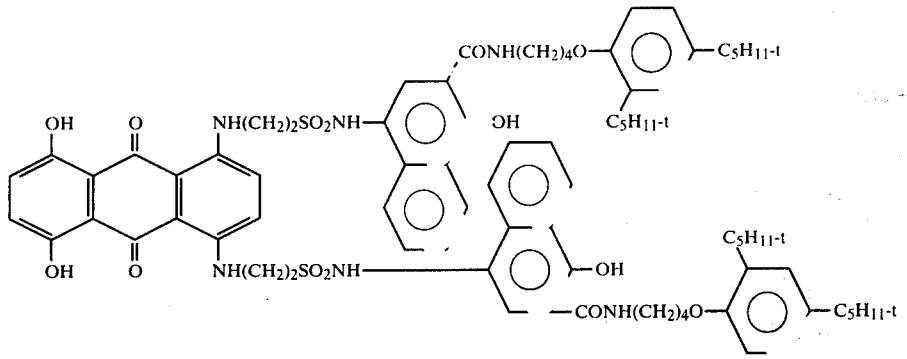
Compound No. XXIII—Shifted Yellow Dye-Providing
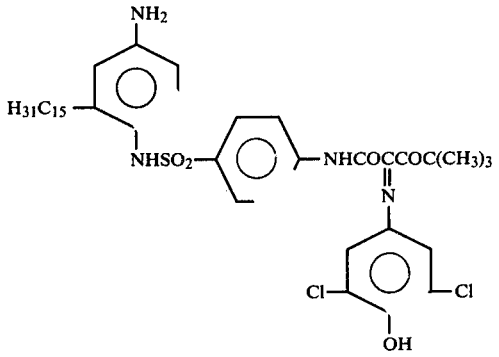
Compound No. XXIV—Shifted Yellow Dye-Providing
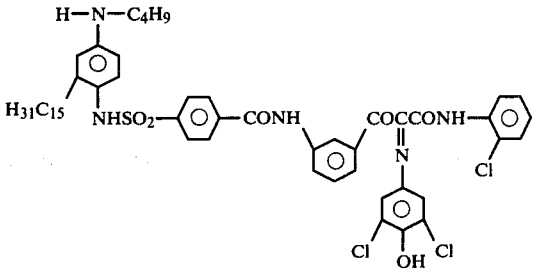
Compound No. XXV—Shifted Magenta Dye-Providing
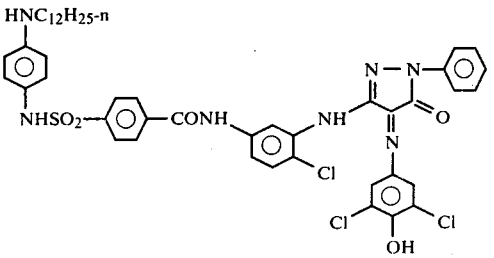
Compound No. XXVI—Shifted Magenta Dye-Providing
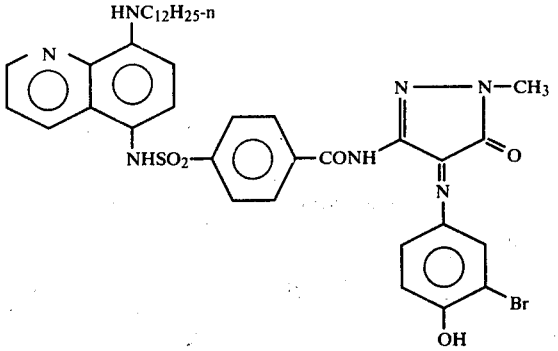
Compound No. XXVII—Shifted Cyan Dye-Providing
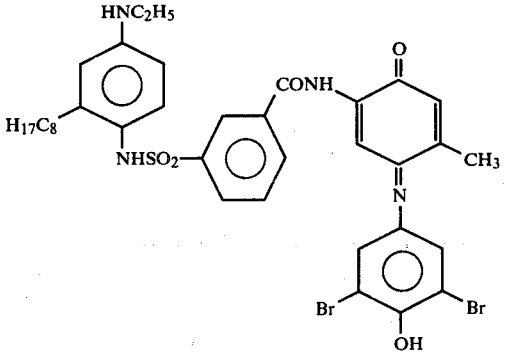
Compound No. XXVIII—Shifted Cyan Dye-Providing
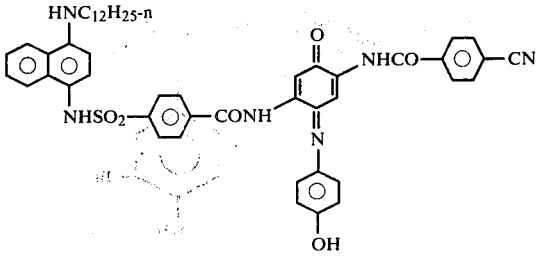

Compound No. XXIX—Yellow Dye-Providing
(Initially Leuco)
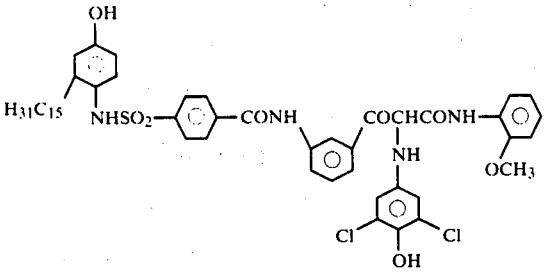
Compound No. XXX—Yellow Dye-Providing
(Initially Leuco)
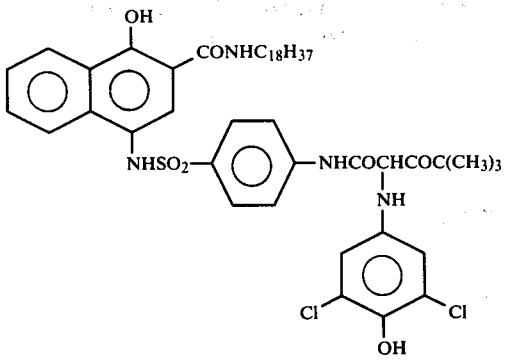
Compound No. XXXI—Magenta Dye-Providing
(Initially Leuco)
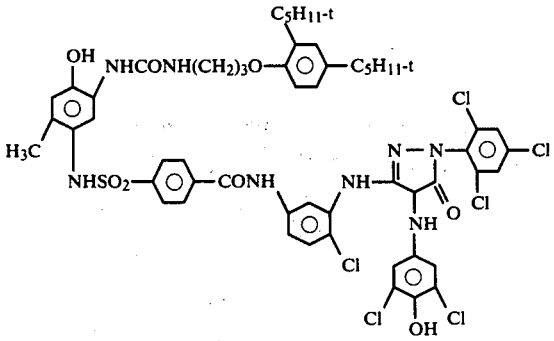
Compound No. XXXII—Magenta Dye-Providing
(Initially Leuco)
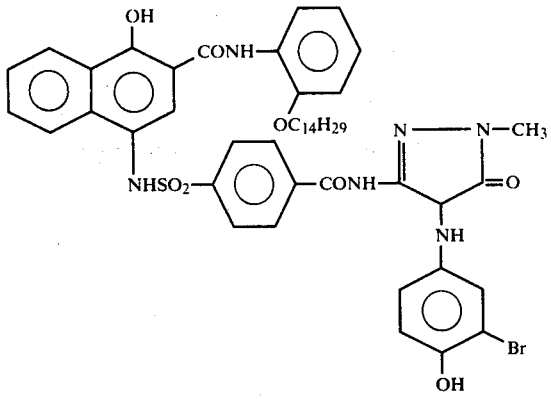
Compound No. XXXIII—Cyan Dye-Providing
(Initially Leuco)
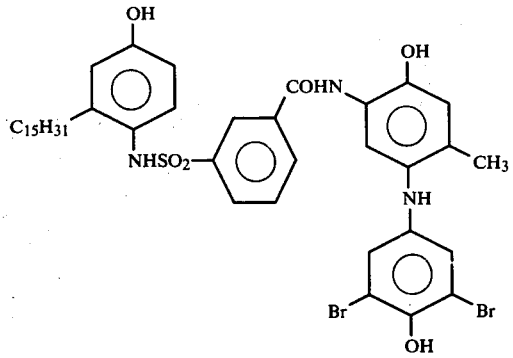
Compound No. XXXIV—Cyan Dye-Providing
(Initially Leuco)
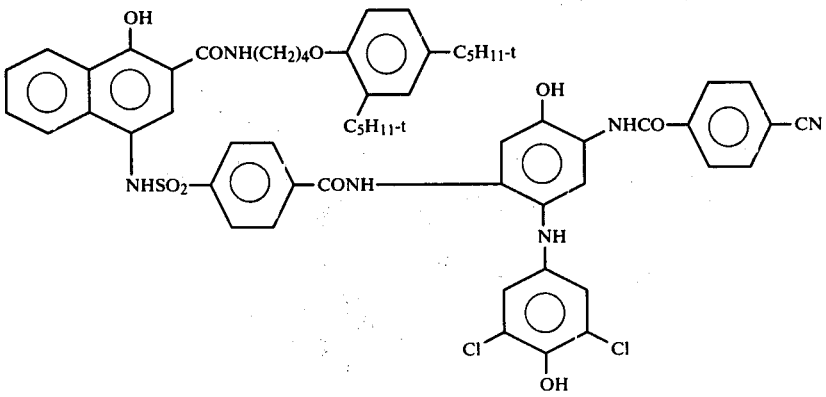

Compound No. XXXV—Yellow Dye-Providing (Initially Leuco)
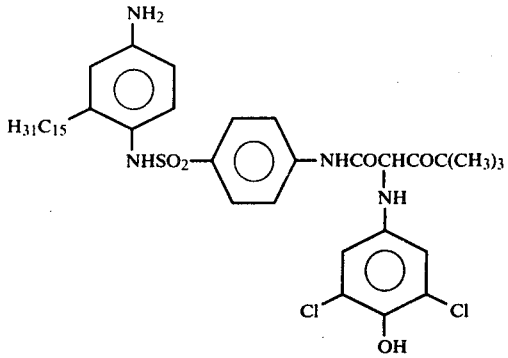
Compound No. XXXVI—Yellow Dye-Providing (Initially Leuco)
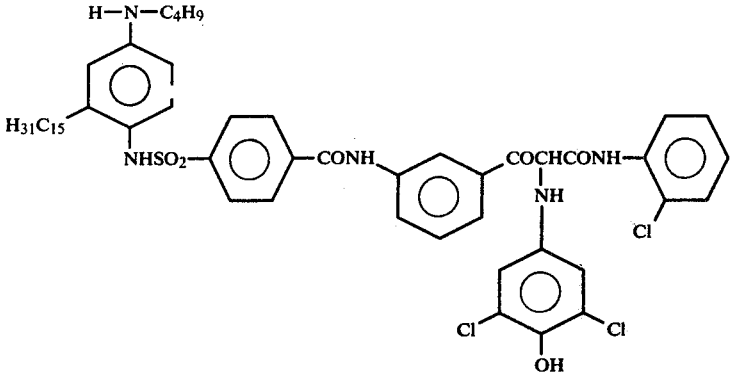
Compound No. XXXVII—Magenta Dye-Providing (Initially Leuco)
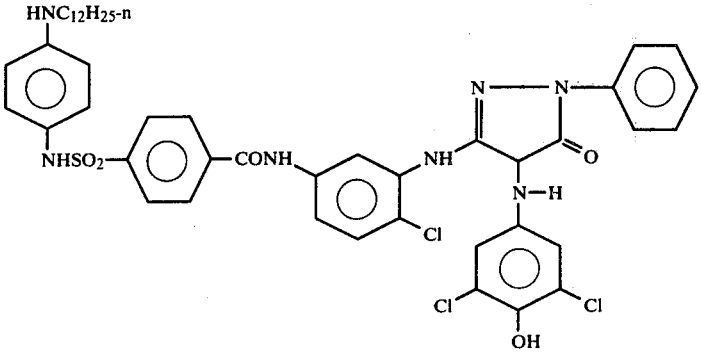
Compound No. XXXVIII—Magenta Dye-Providing (Initially Leuco)
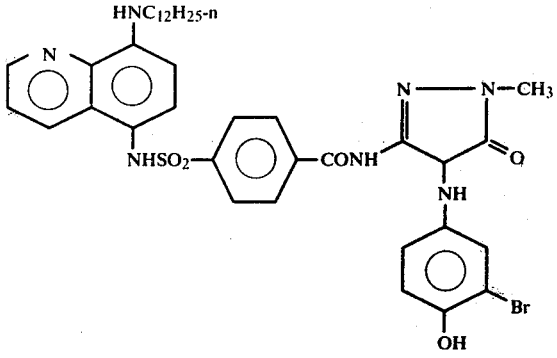
Compound No. XXXIX—Cyan Dye-Providing (Initially Leuco)
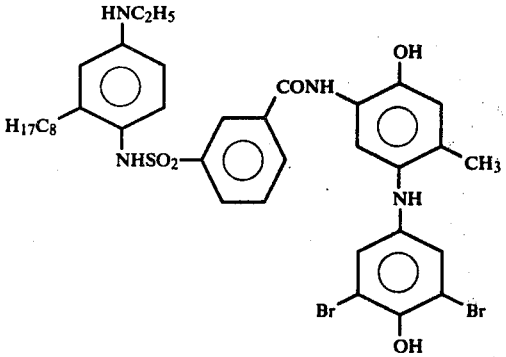

Compound No. XL—Cyan Dye-Providing (Initially Leuco)
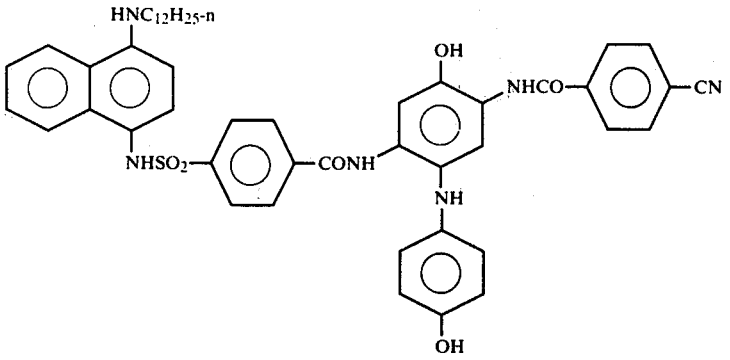
Compound XLI—Yellow Dye-Releasing
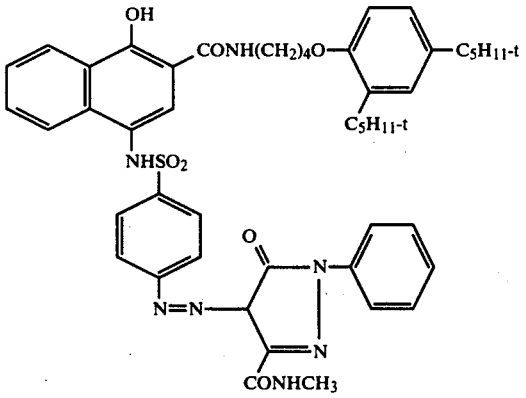
Compound XLII—Magenta Dye-Releasing
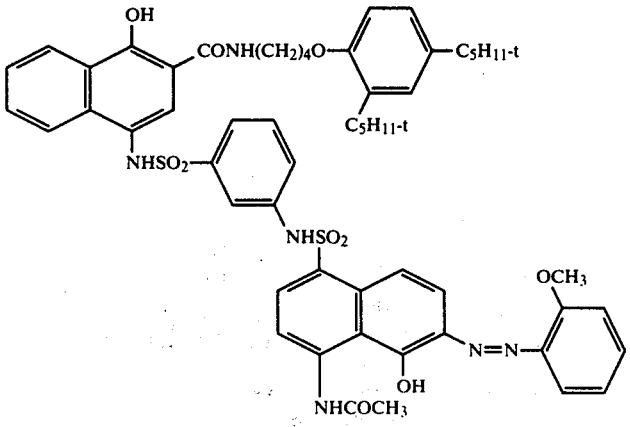
Compound XLIII—Magenta Dye-Releasing
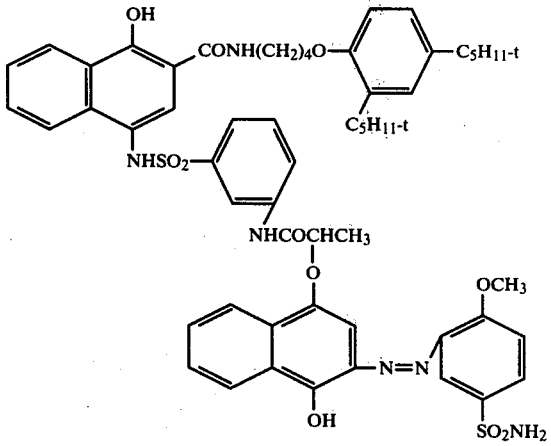

Compound XLIV—Magenta Dye-Releasing

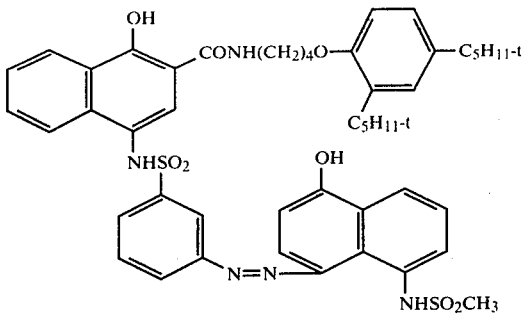

Compound XLV—Cyan Dye-Releasing

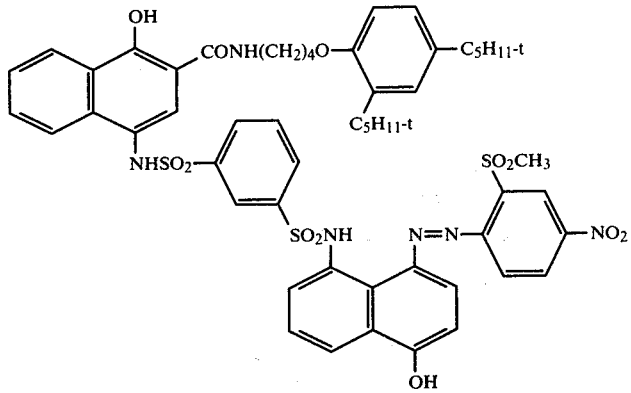

Compound XLVI

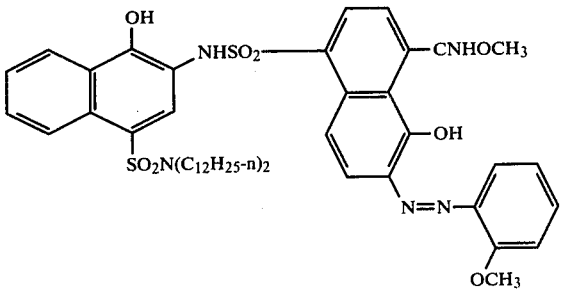

Of the above compounds, especially good results are obtained with Compound Nos. III, IV, V, VI, VII, VIII and XIV. Compounds XLII, XLIII, XLIV and XLV are the subject of separate inventions by our coworkers.

The film unit or assembly used in the process of the present invention may be used to produce positive images in single- or multicolors. In a three-color system, each silver halide emulsion layer of the film assembly will have associated therewith a dye-releasing compound possessing a predominant spectral absorption within the region of the visible spectrum to which said silver halide emulsion is sensitive, i.e., the blue-sensitive silver halide emulsion layer will have a yellow dye-releaser associated therewith, the green-sensitive silver halide emulsion layer will have a magenta dye-releaser associated therewith, and the red-sensitive silver halide emulsion layer will have a cyan dye-releaser associated therewith. The dye-releaser associated with each silver halide emulsion layer may be contained either in the silver halide emulsion layer itself or in a layer contiguous to the silver halide emulsion layer.

The concentration of the compounds which are alkali-cleavable upon oxidation that are employed in the present invention may be varied over a wide range, depending upon the particular compound employed and the results which are desired. For example, the dye-releasers of the present invention may be coated in layers by using coating solutions containing between about 0.5 and about 8 percent by weight of the dye-releaser distributed in a hydrophilic film-forming natural material or synthetic polymer, such as gelatin, polyvinyl alcohol, etc., which is adapted to be permeated by aqueous alkaline processing composition.

Any silver halide developing agent can be employed in our invention as long as it cross-oxidizes with the dye-releasers described herein. The developer may be employed in the photosensitive element to be activated by the alkaline processing composition. Specific examples of developers which can be employed in our invention include:

hydroquinone
N-methylaminophenol
Phenidone (1-phenyl-3-pyrazolidone)
Dimezone (1-phenyl-4,4-dimethyl-3-pyrazolidone)
aminophenols
N-N-diethyl-p-phenylenediamine
3-methyl-N,N-diethyl-p-phenylenediamine
3-methoxy-N-ethyl-N-ethoxy-p-phenylenediamine, etc.

The black-and-white developers in this list are preferred, however, since they avoid any propensity of staining the dye image-receiving layer.

In accordance with our invention, as was mentioned previously, the silver halide developer in our process becomes oxidized upon development and reduces silver halide to silver metal. The oxidized developer then cross-oxidizes the dye-releasing compound. The product of cross-oxidation then undergoes alkaline hydrolysis, thus releasing an imagewise distribution of diffusible sulfonamide dye or dye precursor which then diffuses to the receiving layer to provide the positive dye image. It is believed that the following chemical reactions take place according to a particular preferred process of the invention:

(1) Development of a latent image with hydroquinone, thereby oxidizing it to a quinone

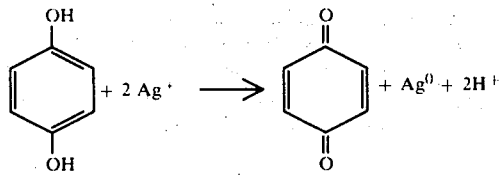

(2) Cross-oxidation step in which quinone is reduced and dye-releasing compound is oxidized

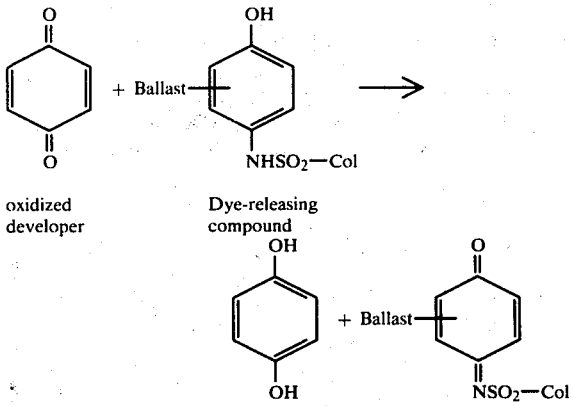

(3) Alkaline hydrolysis to release a diffusible dye

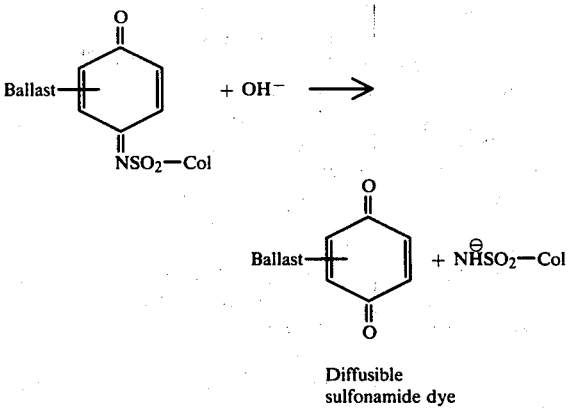

The sulfonamide group on the released dye provides several advantageous features which are useful in photographic elements and especially in image transfer film units. The sulfonamido linkage in our compounds provides a cleavable linkage which cleaves the dye from the ballasted carrier moiety by a simple redox reaction followed by hydrolysis. The sulfonamido group on the released dye according to our invention is also relatively inert and does not appear to enter into side reactions with other components in the photographic element. A sulfinic acid group on certain prior art compounds, however, is a very reactive reducing agent and could enter into additional reactions such as with an azo group which in turn can immobilize dye in unwanted areas. Dye stability could also be a serious problem if a sulfinic acid is present on the released dye. Our sulfonamide dyes, however, are generally more stable than related prior art dyes and can be mordanted in the image-receiving layer with less difficulty.

In using the dye-releasing compounds according to our invention, the production of diffusible dye or dye precursor images is a function of the reduction of developable silver halide images which may involve direct or reversal development of the silver halide emulsions with a silver halide developing agent. If the silver halide emulsion employed is a direct-positive silver halide emulsion, such as an internal-image emulsion or a solarizing emulsion, which is developable in unexposed areas, a positive image can be obtained on the dye image-receiving layer. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the preformed dyes or the dye precursors imagewise as a function of the imagewise exposure of each of the silver halide emulsion layers. At least a portion of the imagewise distributions of diffusible sulfonamide dyes or dye precursors diffuse to the image-receiving layer to form a positive image of the original subject. After being contacted by the alkaline processing composition, a pH-lowering layer in the film unit or image-receiving unit lowers the pH of the film unit or image receiver to stabilize the image.

Internal-image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in the process of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a Carey Lea silver layer can be present between the blue-sensitive and green-sensitive silver halide emulsion layers for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention can be of the type disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

In a color film unit employed in the process of this invention, each silver halide emulsion layer containing a dye-releaser or having the dye-releaser present in a contiguous layer may be separated from the other silver halide emulsion layers in the negative portion of the film unit by materials including gelatin, calcium alginate or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104; 3,043,692; 3,044,873; 3,061,428; 3,069,263; 3,069,264; 3,121,011 and 3,427,158.

Generally speaking, except where noted otherwise, the silver halide emulsion layers employed in the invention comprise photosensitive silver halide dispersed in gelatin and are about 0.6 to 6 microns in thickness; the dye-releasers are dispersed in an aqueous alkaline solution-permeable polymeric binder, such as gelatin, as a separate layer about 1 to 7 microns in thickness; and the alkaline solution-permeable polymeric interlayers, e.g., gelatin, are about 1 to 5 microns in thickness. Of course, these thicknesses are approximate only and can be modified according to the product desired.

Any material can be employed as the image-receiving layer in this invention as long as the desired function of mordanting or otherwise fixing the dye images will be obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Use of a pH-lowering material in the dye image-receiving element of a film unit employed in the process of the invention will usually increase the stability of the transferred image. Generally, the pH-lowering material will effect a reduction in the pH of the image layer from about 13 or 14 to at least 11 and preferably 5 to 8 within a short time after imbibition. Suitable materials and their functioning are disclosed on pages 22 and 23 of the July, 1974 edition of *Research Disclosure* and pages 35 through 37 of the July, 1975 edition of *Research Disclosure,* the disclosures of which are hereby incorporated by reference.

An inert timing or spacer layer can be employed in the practice of our invention over the pH-lowering layer which "times" or controls the pH reduction as a function of the rate at which alkali diffuses through the inert spacer layer. Examples of such timing layers and their functioning are disclosed in the *Research Disclosure* articles mentioned in the paragraph above concerning pH-lowering layers.

The alkaline processing composition employed in this invention is the conventional aqueous solution of an alkaline material, e.g., sodium hydroxide, sodium carbonate or an amine such as diethylamine, preferably processing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

While the alkaline processing composition used in this invention can be employed in a rupturable container, as described previously, to conveniently facilitate the introduction of processing composition into the film unit, other methods of inserting processing composition into the film unit could also be employed, e.g., interjecting processing solution with communicating members similar to hypodermic syringes which are attached either to a camera or camera cartridge.

The alkaline solution-permeable, substantially opaque, light-reflective layer employed in certain embodiments of photographic film units used in the process of our invention are described more fully in the November, 1976 edition of *Research Disclosure,* page 82, the disclosure of which is hereby incorporated by reference.

The supports for the photographic elements used in the process of this invention can be any material as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone.

The silver halide emulsions useful in our invention are well-known to those skilled in the art and are described in *Product Licensing Index,* Vol. 92, December, 1971, publication 9232, p. 107, paragraph I, "Emulsion types"; they may be chemically and spectrally sensitized as described on p. 107, paragraph III, "Chemical sensitization", and pp. 108–109, paragraph XV, "Spectral sensitization", of the above article; they can be protected against the production of fog and can be stabilized against loss of sensitivity during keeping by employing the materials described on p. 107, paragraph V, "Antifoggants and stabilizers", of the above article; they can contain development modifiers, hardeners, and coating aids as described on pp. 107–108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition", of the above article; and they can be coated by using the various techniques described on p. 109, paragraph XVIII, "Coating procedures", of the above article, the disclosures of which are hereby incorporated by reference.

The following examples further illustrate the invention.

EXAMPLE 1

Preparation of Compound No. I

To a solution of 16 g. of 4-amino-3-pentadecylphenol in 100 ml. pyridine cooled in an ice bath is added 14 g. of p-phenylazobenzenesulfonyl chloride. After 5 hours stirring, the mixture is poured into ice water containing 150 ml. concentrated hydrochloric acid. The resulting solid is recrystallized from ethanol, methanol, and acetonitrile to give an orange solid, m.p. 125°–127° C., resolidified, second m.p. 143°–144° C.

EXAMPLE 2

Preparation of Compound No. II

To a solution of 24.5 g of 4-amino-2-(N-[4'-(2,4-di-tert-pentylphenoxy)-butyl]-carbamyl)-naphthol in 150 ml. pyridine cooled in an ice bath is added 15.5 g of p-phenylazobenzenesulfonyl chloride. After 2 hours stirring, the mixture is poured into ice water containing 150 ml concentrated hydrochloric acid. The resulting solid is recrystallized from ethyl acetate and from 1:1 tetrahydrofuran-ethanol to give an orange solid, m.p. 235°-237° C.

EXAMPLE 3

Preparation of Compound No. III

To a suspension of 2.4 g of 4-(p-aminobenzenesulfonamido)-3-pentadecylphenol in a mixture of 75 ml of glacial acetic acid and 6 ml concentrated hydrochloric acid is added a solution of 0.4 g sodium nitrate in 5 ml $H_2O$. The yellow suspension is stirred for one hour, then poured into a solution of 2.4 g acetyl H-acid in 100 ml methanol cooled in an ice bath. 50 Ml of pyridine is then added and the magenta-colored solution is stirred for one hour at 0° C., filtered, and concentrated to dryness under vacuum. The residual is washed with water and acetronitrile and recrystallized from ethanol to give a red solid.

EXAMPLE 4

Preparation of Compound No. IV

To a stirred suspension of 8.5 g of 4-(p-aminobenzenesulfonamido)-3-pentadecylphenol in 240 ml of glacial acetic acid is added 22 ml concentrated hydrochloric acid, followed by a solution of 1.5 g sodium nitrite in 10 ml water. The mixture is stirred at room temperature for one hour, then poured into a solution of 36 g potassium acetate and 4 g 4-isopropoxy-1-naphthol in 400 ml methanol cooled in an ice bath. The mixture is stirred for one hour at 0° C., filtered, and then concentrated to dryness under vacuum. The residue was recrystallized from methanol and isopropyl alcohol to yield a red solid, m.p. 83°-87° C.

EXAMPLE 5

Preparation of Compound No. V

To a stirred suspension of 7.6 g of 4-(p-aminobenzenesulfonamido)-3-pentadecylphenol in 200 ml of glacial acetic acid is added 20 ml concentrated hydrochloric acid, followed by a solution of 1.3 g sodium nitrite in 10 ml water. The mixture is stirred at room temperature for 50 minutes, then poured into a solution of 32 g potassium acetate and 6.1 g N,N-dimethylaniline in 350 ml methanol cooled in an ice bath. The mixture is stirred for one hour at 0° C. and filtered. The collected solid is washed with methanol and water, then recrystallized from ethanol, cyclohexane-ethyl acetate, and isopropyl alcohol to give copper-orange plates, m.p. 141°-157° C.

EXAMPLE 6

A single layer supported gelatinous silver halide (cubic bromide) emulsion coating is prepared which contains per square foot of coating 60 mg of Compound No. I, 120 mg of di-n-butylphthalate, 100 mg of silver and 450 mg of gelatin. A sample of the photosensitive element is exposed to a graduated-density multicolor test object. A processing composition comprising Phenidone developing agent (1-phenyl-3-pyrozolidone) (0.5 g/l), NaOH (0.1 normal), and hydroxyethylcellulose (30 g/l) is employed in a pod and is spread between the exposed surface of the photosensitive element and a superposed dye image-receiving element comprising a support coated with 700 mg/ft$^2$ of gelatin and 150 mg/ft$^2$ of the mordant N-n-octadecyl-tri-butylammonium bromide, by passing the transfer "sandwich" between a pair of juxtaposed pressure rollers.

After five minutes at about 24° C., the film unit is separated. A negative yellow dye image is observed on the dye image-receiving sheet.

EXAMPLE 7

Example 6 is repeated except that the coating contains per square foot of coating 73 mg of Compound No. II, and 730 mg of tri-cresylphosphate. A negative yellow dye image is again obtained on the dye image-receiving sheet.

EXAMPLE 8

The procedure of Example 6 is repeated with a sample of a coating containing 100 mg of Compound No. III per square foot of coating. Compound No. III is incorporated into the emulsion by dissolving a measured quantity of Compound No. III in an ethanol/water mixture and adding the so obtained solution to the emulsion prior to coating. The processing composition emplcyed comprises Phenidone developing agent (0.5 g/l), NaOH (1.0 normal), $Na_2SO_3$ (1 mole) and hydroxyethycellulose (30 g/l. After about 45 seconds at 24° C., a negative red-magenta image is obtained on the receiving sheet.

EXAMPLE 9

The procedure of Example 6 is repeated with a sample of a coating containing per square foot of coating 70 mg of Compound No. IV and 30 mg of di-n-butylphthalate. After 90 seconds at about 24° C., a negative red-magenta image is obtained on the dye image-receiving sheet.

A separate unexposed sample of this coating is treated for five minutes in Kodak F-5 Fix, rinsed with water, dried, emersed in the processing composition described in Example 6, and brought into contact for two minutes with a sample of the dye image-receiving element described above. No dye is transferred.

This example indicates that in order for the compounds employed in our invention to provide a diffusible dye image, the parent phenolic molecule must first be oxidized before release of the dye or dye-precursor.

EXAMPLE 10

The procedure described in Example 6 is repeated with a coating containing per square foot of coating 61 mg of Compound No. V and 122 mg of di-n-butylphthalate. After about 90 seconds at about 24° C., a negative yellow image is obtained on the dye image-receiving sheet.

When an unexposed, fixed strip of this coating is treated with the processing solution and contacted with the receiving sheet for two minutes, no dye is transferred.

This example again indicates the resistance of compounds employed in our invention to provide a diffusible dye image in their reduced, uncleaved state.

EXAMPLE 11

A photosensitive element is prepared by coating on an opaque cellulose acetate film support a negative-working gelatin-silver chlorobromide emulsion (300 mg gelatin/ft$^2$ and 74 mg silver/ft.$^2$) and magenta Compound No. VI (100 mg./ft.$^2$).

A dye image-receiving element is prepared by coating a N-n-hexadecyl-N-morpholinium ethosulfate/-methyl-tri-n-dodecylammonium p-toluenesulfonate coacervate mordant dispersion of the type described in U.S. Pat. No. 3,271,147 of Bush issued Sept. 6, 1966, on an opaque support.

A sample of the photosensitive element is exposed to a graduated-density multicolor test object. The following processing composition is employed in a pod and is spread between the exposed surface of the photosensitive element and the superposed dye image-receiving element by passing the transfer "sandwich" between a pair of juxtaposed pressure rollers:

| | | |
|---|---|---|
| Sodium hydroxide | 20 | g |
| Hydroxyethylcellulose | 25 | g |
| 4-Methyl-4-hydroxymethyl-1-phenyl-3-pyrazolidene | 0.75 | g |
| Water to | 1000 | ml |

After 60 seconds at about 25° C., the dye image-receiving element is separated from the "negative" element. A negative, magenta dye image is observed on the dye image-receiving element.

EXAMPLE 12

The procedure of Example 11 is repeated except that the processing composition does not contain any electron transfer agent 4-methyl-4-hydroxymethyl-1-phenyl-3-pyrazolidone. No visible dye image in the receiving element is obtained and no visible silver development takes place in the "negative" element. This example illustrates that certain compounds employed in our invention are incapable of development themselves and require a separate silver halide developing agent in the system.

EXAMPLE 13

A photosensitive element is prepared by coating on an opaque cellulose acetate film support a negative-working gelatin-silver chlorobromide emulsion (300 mg gelatin/ft$^2$ and 97 mg silver/ft.$^2$) and yellow Compound No. VII (124 mg./ft.$^2$).

This element is exposed and processed as in Example 11 to obtain a negative, yellow dye image on the dye image-receiving element.

EXAMPLE 14

The procedure of Example 13 is repeated except that the processing composition does not contain any electron transfer agent 4-methyl-4-hydroxymethyl-1-phenyl-3-pyrazolidone. No visible dye image in the receiving element is obtained and no visible silver development takes place in the "negative" element. This example illustrates that certain compounds employed in our invention are incapable of development themselves and require a separate silver halide developing agent in the system.

EXAMPLE 15

A multilayer, multicolor photosensitive element is prepared by coating the following layers in the order recited on an opaque cellulose acetate film support:

(a) Red-sensitive, negative-working, gelatin-silver chlorobromide emulsion (300 mg gelatin/ft$^2$ and 97 mg silver/ft$^2$) and yellow Compound No. VII (124 mg./ft.$^2$), (b) An interlayer of gelatin (80 mg/ft$^2$), Phenidone (10 mg/ft$^2$) (incorporated developing agent), 2,5-di-tert-octylhydroquinone (20 mg/ft$^2$) (oxidized color developer scavenger) and yellow filter dye 1-(2,4,6-trichlorophenyl)-3-{3-[α-(2,4-di-tert-amylphenoxy)-acetamido]-benzamido}-4-(4-methoxyphenylazo)-5-pyrazolone (75 mg/ft$^2$), and (c) Blue-sensitive, negative-working, gelatin-silver chlorobromide emulsion (300 mg gelatin/ft$^2$ and 74 mg silver/ft$^2$) and magenta Compound No. VI (100 mg./ft.$^2$).

A sample of the photosensitive element is exposed to a graduated density, multicolor test object. The following processing composition is employed in a pod and is spread between the exposed surface of the photosensitive element and a superposed dye image-receiving element similar to that of Example 11 by passing the transfer "sandwich" between a pair of juxtaposed pressure rollers:

| | |
|---|---|
| Sodium hydroxide | 40 g |
| Hydroxyethylcellulose | 25 g |
| Potassium bromide | 10 g |
| Water to | 1 liter |

(no developing agent is necessary in the processing composition since it is incorporated in the photosensitive element). After 60 seconds at about 25° C., the dye image-receiving element is separated from the "negative" element. A well-defined, negative, two-color magenta-yellow reproduction of the test object is observed on the dye image-receiving element.

EXAMPLES 16–33

Example 11 is repeated with the following alkali-cleavable compounds employed instead of Compound No. VI:

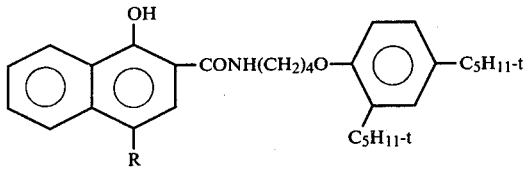

| Example | R | λmax of Image Dye In Receiving Element (nm) |
|---|---|---|
| 16 | 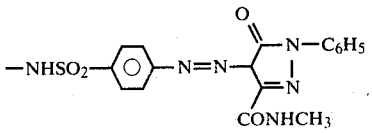 | 450 (yellow) |

-continued
17 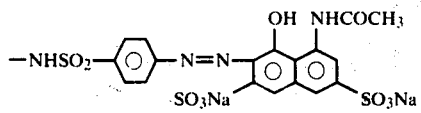
510 (magenta)
18 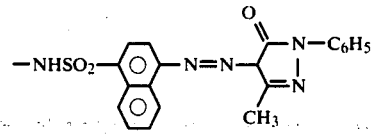
478 (yellow)
19 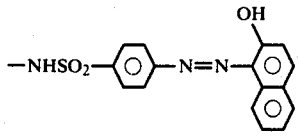
475 (yellow)
20 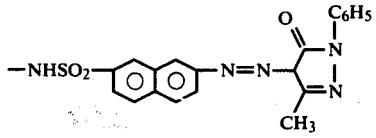
450 (yellow)
21 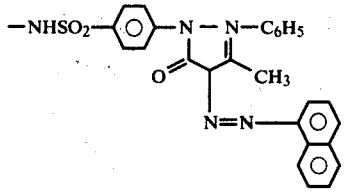
440 (yellow)
22 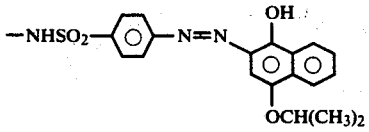
510 (magenta)
23 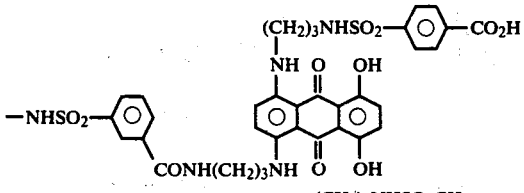
(cyan)
24 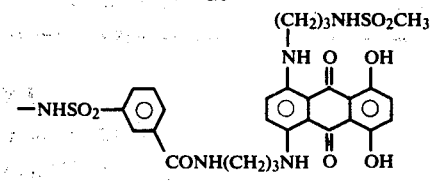
(cyan)
and the compounds having the following structure:
Structure
25 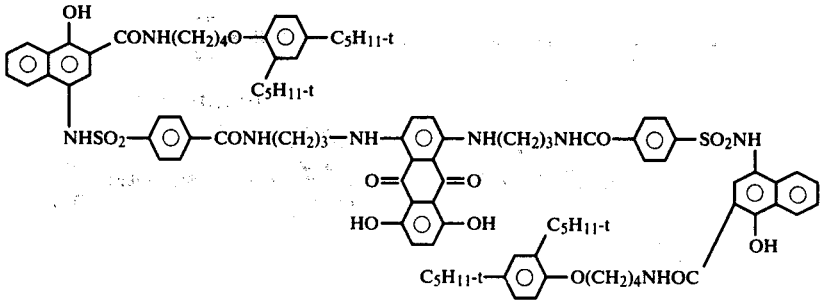
(cyan)
26 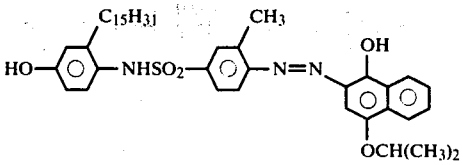
520 (magenta)

-continued
| Example | R | λmax of Image Dye In Receiving Element (nm.) |
|---|---|---|
| 27 | 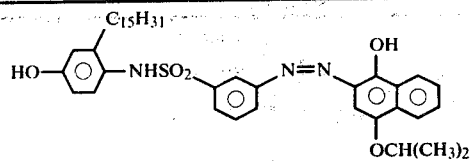 | 510 (magenta) |
| 28 | 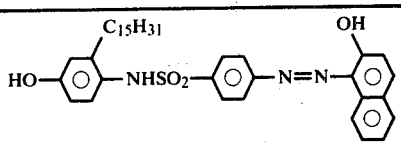 | 475 (yellow) |
| 29 | 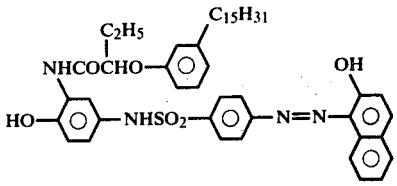 | 475 (yellow) |
| 30 | 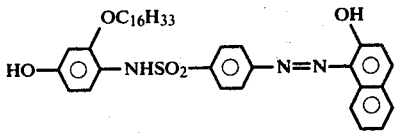 | 475 (yellow) |
| 31 | 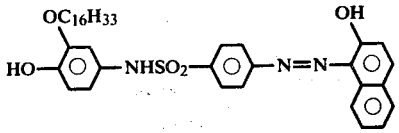 | 475 (yellow) |
| 32 | 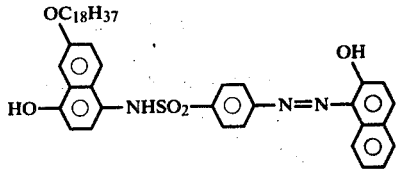 | 475 (yellow) |
| 33 | 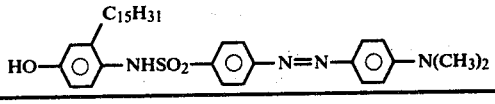 | 425 (yellow) |
EXAMPLE 34
Preparation of Compound No. VIII
Compound VIII is prepared as outlined in the following scheme:
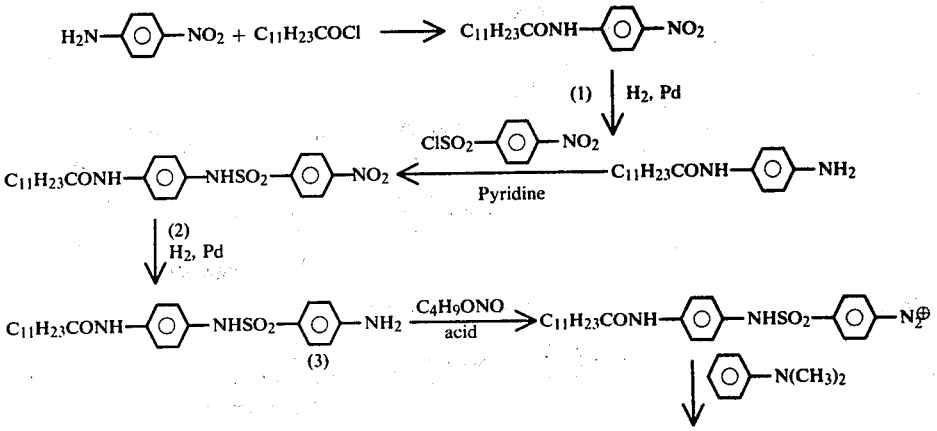

-continued

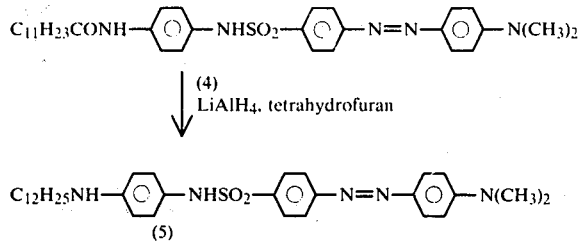

Procedures are as follows:

(a) 4-nitrolauranilide (1)—Lauroyl chloride (109 g., 0.50 mole) is added portionwise over a 5-minute period to a mixture of 69 g. (0.50 mole) of 4-nitroaniline and 61 g. (0.50 mole) of N,N-dimethylaniline in 250 ml. of tetrahydrofuran solvent. The mixture is allowed to stand at ambient temperature for 1 hour. It is poured into 2.5 liters of water containing 10 ml. of concentrated hydrochloric acid. The solid which precipitates is filtered off, pressed dry and recrystallized from 750 ml. of acetonitrile. The yield of product is 154 g., m.p. 80°-81° C.

(b) 4-(4-nitrobenzenesulfonamido)lauranilide (2)—The nitrolauranilide (1) (32.0 g., 0.10 mole) in 150 ml. of tetrahydrofuran solvent is reduced at 3 atm. hydrogen pressure over a Pd-C catalyst. The catalyst is filtered off and the solvent stripped from the filtrate in vacuo. The crude amine is dried by adding 50 ml. of ethyl acetate and removing the ethyl acetate in vacuo. The white product is taken up in 150 ml. of pyridine and 22.2 g. (0.10 mole) of 4-nitrobenzenesulfonyl chloride is added. The pyridine solution is heated at the boiling point for 20 minutes, during which time the deep red solution becomes straw-colored. The solution is poured into 1 liter of water. The tan solid is filtered, pressed dry and recrystallized from 800 ml. of acetonitrile. The yield is 43.0 g., m.p. 184°-5° C.

(c) 4-(4-aminobenzenesulfonamido)lauranilide (3)—The nitro compound (2) (86.8 g., 1.82 moles) is hydrogenated over Pd-C at 3 atm. pressure, using 250 ml. of tetrahydrofuran as solvent for each run. Reduction is done at 40°-45° C. The theoretical amount of hydrogen is consumed in 1 hour. The batch is filtered and solvent removed in vacuo. The product is recrystallized from 400 ml. of acetonitrile to give 75.1 g. of amine, m.p. 151°-53° C.

(d) Diazotization of amine (3) and coupling to 4-(4-dimethylaminophenylazo)benzenesulfonamidolauranilide (4)—The amine (3) (4.45 g., 0.01 mole) is suspended in 40 ml. of dioxane and 10 cc. of tetrahydrofuran. Concentrated sulfuric acid (2.2 ml., 0.04 mole) is added with cooling to keep the temperature at 20° C. The solution is cooled to 5° C. and 1.20 cc. (0.01+ mole) of butyl nitrite is added with good stirring over a 5-minute period. The reaction mixture is allowed to stand at 5°-10° C. for 20 minutes. It is poured into a chilled solution of 1.30 ml. (0.01+ mole) of N,N-dimethylaniline and 6.6 g. (0.08 mole) of sodium acetate in 30 ml. of methanol containing 5 ml. of water. An orange product separates. The mixture is poured into water. The orange solid is filtered, washed with water and air-dried. The product is recrystallized from ethyl acetate tetrahydrofuran to give a total (first and second crops) of 2.86 g. of dye, m.p. 214°-215° C.

(e) 4-(4-dimethylaminophenylazo)benzenesulfonamido-N-dodecylaniline (5)—The lauranilide (4) (6.20 g., 0.0108 (mole) is dissolved in 250 ml. of tetrahydrofuran solvent previously dried over Linde 4A molecular sieves. To the stirred solution is added as rapidly as possible 2.05 g. (0.054 mole) of lithium aluminum hydride. The mixture is stirred at room temperature for ¾ of an hour. Hydrated sodium sulfate is added to destroy unused hydride, followed by 0.7 ml. of acetic acid. Inorganic salts are filtered off and washed well with fresh tetrahydrofuran. The filtrate is concentrated to dryness on a rotary evaporator and the residue is recrystallized from 200 ml. of 50-50 methanol-tetrahydrofuran to give 4.6 g. of orange plates; m.p. 199.5°-200° C.

EXAMPLE 35

A single-layer supported gelatinous silver halide (cubic bromide) emulsion coating is prepared which contains per square foot of coating 60 mg. of Compound No. VIII, 0.6 ml. of diethyl lauramide, 400 mg. of gelatin and 180 mg. of silver. A sample of the photosensitive element is exposed to a graduated-density multicolor test object. A processing composition comprising Phenidone developing agent (0.25 g/l), NaOH (1 normal) and hydroxyethylcellulose (30 g/l) is employed in a pod and is spread between the exposed surface of the photosensitive element and a superposed dye image-receiving element comprising a support coated with 700 mg./ft.$^2$ of gelatin and 150 mg./ft.$^2$ of the mordant N-n-octadecyl-tri-butylammonium bromide, by passing the transfer "sandwich" between a pair of juxtaposed pressure rollers.

After 1 minute at about 22° C., the film unit is separated. A negative yellow dye image of the test object is observed on the dye image-receiving sheet.

EXAMPLE 36

Preparation of Compound No. XIV

Compound XIV is prepared according to the following procedure:

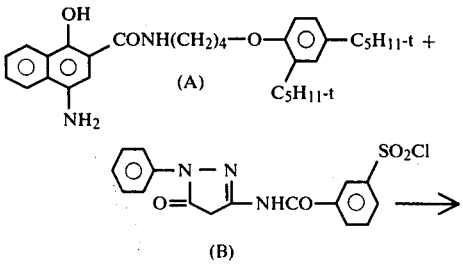

-continued

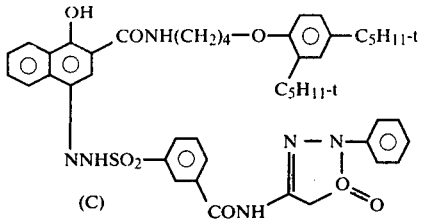

Equimolar (0.1 mol.) amounts of the amino naphthol (A) and the sulfonyl chloride (B) are allowed to react in tetrahydrofuran for 2½ hours at room temperature. After the product has separated from solution on addition of water, it is recrystallized from methanol and water, m.p. 143°–146° C.

Substituted pyrazolone (C) is oxidatively coupled with 2,6-dibromo-4-aminophenol according to the following scheme:

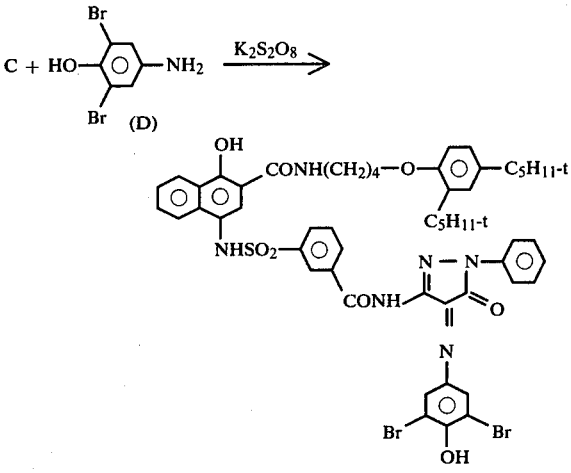

Compound XIV

The above reaction is run by using equimolar (0.00228 mol.) quantities of (C), the aminophenol (D) and $K_2S_2O_8$ oxidant in a mixture of dilute aqueous $Na_2CO_3$ and n-butyl alcohol. The crude product is recovered from the organic phase, following washing and drying, by solvent removal. It is then purified by column chromatography, m.p. >200° C. with decomposition.

EXAMPLE 37

A single-layer supported gelatinous silver halide emulsion coating is prepared which contains per square foot of coating 107 mg. of Compound No. XIV dispersed 1:1 in coupler solvent diethyl lauramide, 300 mg. of gelatin and 86 mg. of silver. Adjacent portions of the photosensitive element are (a) unexposed and (b) exposed to room light to achieve a high Dmax upon development. The element is then processed for 1 minute at 24° C. while in contact with a receiving element containing a styrene-dimethyl-benzyl ammonium-trimethylene-maleamide copolymer cationic mordant in the presence of the following viscous processing composition:

| | |
|---|---|
| NaOH | 20 g. |
| hydroxyethyl cellulose | 25 g. |
| 4-methyl-4-hydroxymethyl-1-phenyl-3-pyrazolidone | 0.75 g. |
| potassium bromide | 10 g. |
| water to 1 liter | |

After separation of the receiving element from the negative, the portion of the receiving element opposite the exposed portion of the negative is found to have a magenta color, showing that image transfer of the dye has taken place, whereas no dye is present in the portion of the receiving element opposite the unexposed portion of the negative.

Another sample of the unprocessed photosensitive element from which the silver halide has been removed by fixation is only slightly colored, thus showing that Compound No. XIV "shifts" during processing.

EXAMPLE 38

Preparation of Compound No. XV

Compound XV is prepared by coupling of sulfonamidophenol (E):

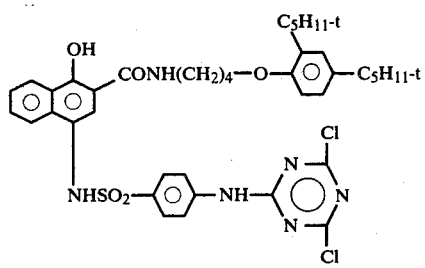

(E)

with a preferred indophenol leuco dye of the following structure:

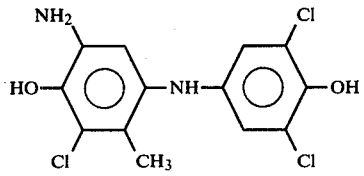

(F)

Compound (F) is made according to the following sequence of reactions:

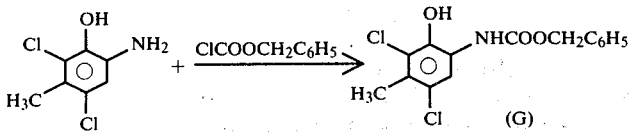

(G)

-continued

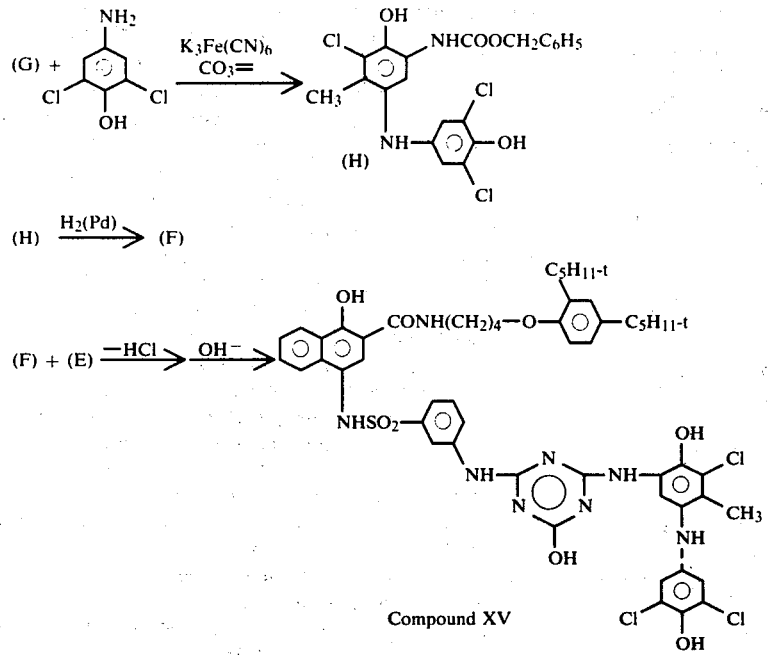

EXAMPLE 39

A single-layer supported gelatinous silver halide emulsion coating is prepared which contains per square foot of coating 107 mg. of Compound No. XV dispersed 1:1 in coupler solvent diethyl lauramide, 300 mg. of gelatin and 86 mg. of silver. A sample of the photosensitive element is exposed to a graduated-density multicolor test object and then processed as in Example 37 while in contact with a receiving element described in Example 37. After 1 minute at 24° C., the dye image-receiving element is separated from the negative. A cyan reproduction of the test object is observed on the dye image-receiving element.

Another sample of the photosensitive element from which the silver halide has been removed by fixation prior to development has a faint pink color. This indicates that the leuco Compound No. XV remains substantially unoxidized in the coating but is oxidized to form a dye after processing and becoming mordanted on the dye image-receiving element.

EXAMPLE 40

An integral multicolor photosensitive element is prepared by coating the following layers in the order recited on a transparent cellulose acetate film support:

(1) image-receiving layer of copoly[styrene-N-benzyl-N,N-dimethyl-N-(3-maleimidopropyl)ammonium chloride] (200 mg./ft.$^2$) and gelatin (100 mg./ft.$^2$);
(2) reflecting layer of titanium dioxide (2000 mg./ft.$^2$) and gelatin (200 mg./ft.$^2$);
(3) opaque layer of carbon black (250 mg./ft.$^2$) and gelatin (312 mg./ft.$^2$);
(4) Compound XLV (65 mg./ft.$^2$) and gelatin (100 mg./ft.$^2$);
(5) red-sensitive, internal-image gelatin-silver chlorobromide emulsion (100 mg. gelatin/ft.$^2$ and 125 mg. silver/ft.$^2$), 2,5-di-sec-dodecylhydroquinone (25 mg./ft.$^2$) and nucleating agent formyl-4-methylphenylhydrazine (1 g./mole of silver);
(6) interlayer of gelatin (100 mg./ft.$^2$) and 2,5-di-sec-dodecylhydroquinone (50 mg./ft.$^2$);
(7) Compound XLIII (150 mg./ft.$^2$) and gelatin (175 mg./ft.$^2$);
(8) green-sensitive, internal-image gelatin-silver chlorobromide emulsion (125 mg. gelatin/ft.$^2$ and 150 mg. silver/ft.$^2$), 2,5-di-sec-dodecylhydroquinone (50 mg./ft.$^2$) and nucleating agent formyl-4-methylphenylhydrazine (1 g./mole of silver);
(9) interlayer of gelatin (100 mg./ft.$^2$) and 2,5-di-sec-dodecylhydroquinone (50 mg./ft.$^2$);
(10) Compound XLI (100 mg./ft.$^2$) and gelatin (150 mg./ft.$^2$);
(11) blue-sensitive, internal-image gelatin-silver chlorobromide emulsion (100 mg. gelatin/ft.$^2$ and 150 mg. silver/ft.$^2$), 2,5-di-sec-dodecylhydroquinone (50 mg./ft.$^2$) and nucleating agent formyl-4-methylphenylhydrazine (1 g./mole of silver); and
(12) overcoat of gelatin (82.5 mg./ft.$^2$).

The above silver halide emulsions are direct-positive emulsions having high internal sensitivity and low surface sensitivity of the type described in U.S. Pat. No. 2,592,250.

The above-prepared photosensitive element is then exposed to a graduated-density multicolor test object. The following proceeding composition is employed in a pod and is spread between the photosensitive element and an opaque cellulose acetate sheet by passing the transfer "sandwich" between a pair of juxtaposed pressure rollers:

| | | |
|---|---|---|
| sodium hydroxide | 40 | g. |
| 4-hydroxymethyl-4-methyl-1-phenyl-3-pyrazolidone | 4 g. | |
| 5-methylbenzyltriazole | 0.1 | g. |
| potassium iodide | 0.01 | g. |
| hydroxyethyl cellulose | 25 | g. |
| distilled water to | 1000 ml. | |

After 4 minutes, the element is separated from the opaque sheet, subjected to a 1-minute acid rinse, fixed for 4 minutes, washed and dried. The following sensitometric results are obtained.

| Maximum Density | | | Minimum Density | | |
|---|---|---|---|---|---|
| Red | Green | Blue | Red | Green | Blue |
| 1.24 | 1.58 | 1.96 | 0.36 | 0.42 | 0.42 |

Compound No. XLI used in this example is prepared as follows: To a solution of 7.3 g. (0.015 mole) of 1-hydroxy-4-amino-N[Δ-(2,4-di-t-amylphenoxy)butyl]-2-naphthamide in 60 ml. of dry pyridine cooled to 2° C. in an ice bath and stirred in a nitrogen atmosphere are added 6.4 g. (0.016 mole) of 1-phenyl-3-methylcarbamyl-4-(p-chlorosulfonylphenylazo)-5-pyrazolone. The mixture is stirred for 2 hours at room temperature and poured into 1 liter of ice and water containing 75 ml. of hydrochloric acid. The precipitate is collected, dried and recrystallized to give 10.4 g. of compound XLI.

EXAMPLE 41

Example 40 is repeated except that, in layer 7, Compound XLII is employed instead of XLIII at the same concentration. The following sensitometric results are obtained:

| Maximum Density | | | Minimum Density | | |
|---|---|---|---|---|---|
| Red | Green | Blue | Red | Green | Blue |
| 1.20 | 1.55 | 2.02 | 0.45 | 0.40 | 0.40 |

EXAMPLE 42

Example 40 is repeated except that, in layer 7, Compound XLIV is employed at a concentration 95 mg./ft.$^2$ instead of Compound XLIII. The following sensitometric results are obtained.

| Maximum Density | | | Minimum Density | | |
|---|---|---|---|---|---|
| Red | Green | Blue | Red | Green | Blue |
| 1.26 | 1.60 | 2.52 | 0.48 | 0.48 | 0.54 |

Compounds XLII, XLIII, XLIV and XLV used in Examples 40, 41 and 42 are the subject of separate inventions by our coworkers. The preparations of these compounds are given herein solely to provide a complete disclosure.

Preparation of Compound XLII

To a solution of 6.45 g. (0.01 mol) of 4-aminophenylsulfamoyl-3-[2,4-bis(isopentyl)phenoxybutylcarbamoyl]-4-hydroxynaphthalene in 100 ml. of pyridine (Karl Fischer grade) at 0° C., under nitrogen, are added 4.3 g. (0.01 mol) of 4-acetamido-5-hydroxy-6-(2-methoxyphenylazo)-1-naphthalene sulfonyl chloride. The mixture is stirred at <5° C. for 30 minutes and then warmed until solution is effected. Heating is discontinued and the solution is stirred for an additional 30 minutes. The solution is poured into 200 ml. of ice and 100 ml. of concentrated hydrochloric acid. The solid is collected on a filter funnel and dried to yield 10.0 g. (96%). After one recrystallization from 300 ml. of acetic acid, the yield of pure Compound XLII is 6.1 g. (59%), m.p. 234°-6° dec.

Preparation of Compound XLIII

Predistilled N,N-dimethylformamide (250 ml.) is added to a dried flask containing 22.2 g. (0.05 mol) of α-[4-hydroxy-3-(2-methoxy-5-sulfamylphenylazo)-1-naphthoxy]propionic acid, 32.5 g. (0.05 mol) of 1-hydroxy-4-m-amino benzenesulfamyl-N-[Δ-(2,4-di-t-amylphenoxy)butyl]-2-naphthamide, and 12.3 g. (0.05 mol) of N-ethoxycarbonyl-2-ethoxy-1,2-dihydroquinoline. The reaction is protected from atmospheric moisture and stirred at room temperature for 4 hours. The reaction is cooled in an ice bath and a solution of 25 g. (0.3 mole) of sodium bicarbonate in 500 ml. of water is added in portions to precipitate an oily solid. An additional 500 ml. of water is added to complete the precipitation. The liquid is decanted from the oily solid and the solid is washed repeatedly with water until the water phase is almost colorless. Any oily solid removed in the original or subsequent decantations is recovered by filtration and thorough washing with water. The oily product is mechanically stirred in 250 ml. of water for 1½ hours to give a crystalline material which is further ground up under water using a mortar and pestle. The resulting slurry is filtered, the solid is washed with water and dried to yield 52 g. (97%) of product, m.p. 120°-160° C. The crude product is purified by stirring the product in 300 ml. of acetic acid at room temperature for 1½ hours. The solid is dissolved and reprecipitated. The slurry is filtered and the solid washed with 200 ml. of cold acetic acid followed by 500 ml. of water. The yield of pure Compound XLIII is 38 g. (71%), m.p. 168°-171° C., λmax (Dimethylacetamide with triethylamine present) 520-545 nm.

Preparation of Compound XLIV

To a solution of 8.0 g. (0.095 mol) of sodium bicarbonate and 12.2 g. (0.0248 mole) of 1-amino-3-[2,4-bis-(isopentyl)phenoxybutylcarbamoyl]-4-hydroxynaphthalene in 80 ml. of dimethylsulfoxide, under nitrogen, are added 10.34 g. (0.0245 mol) of N-[5-hydroxy-8-(3-fluorosulfonylphenylazo)-1-naphthyl]methanesulfonamide. The mixture is heated on a steam bath for 90 minutes and poured into 1 liter of ice water containing 25 ml. of concentrated hydrochloric acid. The solid is collected on a filter funnel and dried. After one slurry in 400 ml. of hot toluene and one slurry in 100 ml. of acetic acid, the yield of Compound XLIV is 12.0 g. (55%).

Preparation of Compound XLV

A mixture of 3.0 g. of sodium bicarbonate, 4.93 g. (8.10 mole) of 5-(3-fluorosulfonylbenzenesulfonamido)-4-(2-methylsulfonyl-4-nitrophenylazo)-1-naphthol, and 3.97 g. (8.10 mmole) of 1-hydroxy-4-amino-N-[Δ-(2,4-di-t-amylphenoxy)butyl]-2-naphthamide in 30 g. dry dimethylsulfoxide is stirred at 80°-100° C. for 60 minutes, cooled, and poured onto ice water containing sufficient hydrochloric acid to neutralize the excess sodium bicarbonate. The precipitated solid is filtered, washed and dried. The product is chromatographed on a silica gel-cellulose dry-packed column to obtain a purified sample of Compound XLIV.

The invention has been described with particular reference to certain preferred embodiments thereof, but it will be understood that variations and modifications can be effected within the spirit and scope of the invention.

What is claimed is:

1. In a photographic element comprising a support having thereon at least one photosensitive silver halide emulsion layer having associated therewith a dye-releasing compound, said compound comprising a benzene nucleus containing the necessary substituents to provide a phenol group, a naphthol group or an aniline group, said compound having a ballast group which renders said compound nondiffusible during development in an alkaline processing composition, said compound having a dye or dye-precursor moiety attached to said benzene nucleus through a sulfonamido linkage, said ballast group being a separate and distinct moiety from said dye or dye-precursor moiety, the improvement wherein said sulfonamido linkage is a cleavable linkage that is oxidizable to a sulfonimide linkage so that the diffusible moiety:

$^{\ominus}HN—SO_2—Col,$ wherein Col is a dye or dye-precursor, is released upon alkaline hydrolysis of the resulting oxidized compound.

2. The element of claim 1 wherein said dye-releasing compound is a sulfonamidonaphthol.

3. The element of claim 1 wherein said Col is an azo dye.

4. In a photographic element comprising a support having thereon a red-sensitive silver halide emulsion layer having associated therewith cyan dye-releasing compound, a green-sensitive silver halide emulsion layer having associated therewith magenta dye-releasing compound, and a blue-sensitive silver halide emulsion layer having associated therewith yellow dye-releasing compound, each of said dye-releasing compounds comprising a benzene nucleus containing the necessary substituents to provide a phenol group, a naphthol group or an aniline group, each of said dye-releasing compounds having a ballast group which renders said compound nondiffusible during development in an alkaline processing composition, each of said dye-releasing compounds having a dye or dye-precursor moiety attached to said benzene nucleus through a sulfonamido linkage, said ballast group being a separate and distinct moiety from said dye or dye-precursor moiety, the improvement wherein said sulfonamido linkage is a cleavable linkage that is oxidizable to a sulfonimide linkage so that the diffusible moiety:

$^{\ominus}HN—SO_2—Col,$ wherein Col is a dye or dye-precursor, is released upon alkaline hydrolysis of the resulting oxidized compound.

5. In a process for producing a photographic image in color, comprising:

(a) imagewise-exposing a photographic element comprising a support having thereon a red-sensitive silver halide emulsion layer having associated therewith cyan dye-releasing compound, a green-sensitive silver halide emulsion layer having associated therewith magenta dye-releasing compound, and a blue-sensitive silver halide emulsion layer having associated therewith yellow dye-releasing compound, each of said dye-releasing compounds comprising a benzene nucleus containing the necessary substituents to provide a phenol group, a naphthol group or an aniline group, each of said dye-releasing compounds having a ballast group which renders said compound nondiffusible during development in an alkaline processing composition, each of said dye-releasing compounds having a dye or dye-precursor moiety attached to said benzene nucleus through a sulfonamido linkage, said ballast group being a separate and distinct moiety from said dye or dye-precursor moiety; and (b) treating said photographic element with an alkaline processing composition in the presence of a silver halide developing agent to effect development of said exposed silver halide emulsion layers, thereby forming in the respective layers an imagewise pattern of oxidized developing agent;

the improvement wherein said sulfonamido linkage is a cleavable linkage that is oxidizable to a sulfonimide linkage so that the diffusible moiety:

$^{\ominus}HN—SO_2—Col,$ wherein Col is a dye or dye-precursor, is released upon alkaline hydrolysis of the resulting oxidized compound;

(i) said imagewise patterns of oxidized developing agent causing imagewise cross-oxidation of said dye-releasing compounds to oxidize said sulfonamido linkage to said sulfonimide linkage;

(ii) said imagewise-oxidized dye-releasing compounds then cleaving as a result of alkaline hydrolysis at said sulfonimide linkage to provide an $^{\ominus}HN—SO_2—$ solubilizing group on said Col, thereby releasing said diffusible moiety $^{\ominus}HN—SO_2—Col$ in imagewise distribution; and (iii) at least a portion of said imagewise distribution of said diffusible moiety diffusing out of said element.

6. In a process for producing a photographic transfer image in a dye image-receiving layer comprising:

(a) imagewise-exposing a photographic element comprising a support having thereon at least one photosensitive silver halide emulsion layer having associated therewith a dye-releasing compound, said compound comprising a benzene nucleus containing the necessary substituents to provide a phenol group, a naphthol group or an aniline group, said compound having a ballast group which renders said compound nondiffusible during development in an alkaline processing composition, said compound having a dye or dye-precursor moiety attached to said benzene nucleus through a sulfonamido linkage, said ballast group being a separate and distinct moiety from said dye or dye-precursor moiety; and (b) treating said photographic element with an alkaline processing composition in the presence of a silver halide developing agent to effect development of said exposed silver halide emulsion, thereby forming an imagewise pattern of oxidized developing agent;

the improvement wherein said sulfonamido linkage is a cleavable linkage that is oxidizable to a sulfonimide linkage so that the diffusible moiety:

$^{\ominus}NH—SO_2—Col,$ wherein Col is a dye or dye-precursor, is released upon alkaline hydrolysis of the resulting oxidized compound;

(i) said imagewise pattern of oxidized developing agent thus causing imagewise cross-oxidation of said dye-releasing compound to oxidize said sulfonamido cleavage linkage to said sulfonimide linkage;

(ii) said imagewise-oxidized dye-releasing compound then cleaving as a result of alkaline hydrolysis at said sulfonimide linkage to provide an $\ominus HN—SO_2—$solubilizing group on said Col, thereby releasing said diffusible moiety $\ominus HN—SO_2—Col$ in imagewise distribution; and (iii) at least a portion of said imagewise distribution of diffusible $\ominus HN—SO_2—Col$ then diffusing to said dye image-receiving layer to provide said transfer image.

7. In a process for producing a photographic image in color comprising:

(a) imagewise-exposing a photographic element comprising a support having thereon at least one photosensitive silver halide emulsion layer having associated therewith a dye-releasing compound, said compound comprising a benzene nucleus containing the necessary substituents to provide a phenol group, a naphthol group or an aniline group, said compound having a ballast group which renders said compound nondiffusible during development in an alkaline processing composition, said compound having a dye or dye-precursor moiety attached to said benzene nucleus through a sulfonamido linkage, said ballast group being a separate and distinct moiety from said dye or dye-precursor moiety; and (b) treating said photographic element with an alkaline processing composition in the presence of a silver halide developing agent to effect development of said exposed silver halide emulsion, thereby forming an imagewise pattern of oxidized developing agent;

the improvement wherein said sulfonamido linkage is a cleavable linkage that is oxidizable to a sulfonimide linkage so that the diffusible moiety:

$$\ominus HN—SO_2—Col,$$

wherein Col is a dye or dye-precursor, is released upon alkaline hydrolysis of the resulting oxidized compound;

(i) said imagewise pattern of oxidized developing agent thus causing imagewise cross-oxidation of said dye-releasing compound to oxidize said sulfonamido cleavage linkage to said sulfonimide linkage;

(ii) said imagewise-oxidized dye-releasing compound then cleaving as a result of alkaline hydrolysis at said sulfonimide linkage to provide an $\ominus HN—SO_2—$solubilizing group on said Col, thereby releasing said diffusible moiety $\ominus HN—SO_2—Col$ in imagewise distribution; and (iii) at least a portion of said imagewise distribution of diffusible $\ominus HN—SO_2—Col$ then diffusing out of said element.

8. The process of claim 7 wherein said dye-releasing compound is a sulfonamidonaphthol.

9. The process of claim 7 wherein said Col is an azo dye.

* * * * *